US008480541B1

(12) United States Patent
Brunts

(10) Patent No.: US 8,480,541 B1
(45) Date of Patent: Jul. 9, 2013

(54) USER FOOTFALL SENSING CONTROL SYSTEM FOR TREADMILL EXERCISE MACHINES

(76) Inventor: Randall Thomas Brunts, Carmel, IN (US)

( * ) Notice: Subject to any disclaimer, the term of this patent is extended or adjusted under 35 U.S.C. 154(b) by 979 days.

(21) Appl. No.: 12/456,793

(22) Filed: Jun. 23, 2009

(51) Int. Cl.
*A63B 71/00* (2006.01)

(52) U.S. Cl.
USPC ..... 482/7; 482/4; 482/1

(58) Field of Classification Search
USPC ..... 482/1, 3, 4, 7, 8, 51, 54
See application file for complete search history.

(56) References Cited

U.S. PATENT DOCUMENTS

| | | | | |
|---|---|---|---|---|
| 1,919,627 | A * | 7/1933 | Fitz Gerald | 482/7 |
| 4,708,337 | A | 11/1987 | Shyu | |
| 5,209,710 | A * | 5/1993 | Shimizu et al. | 482/54 |
| 5,314,391 | A | 5/1994 | Potash | |
| 5,368,532 | A | 11/1994 | Farnet | |
| 5,476,430 | A * | 12/1995 | Lee et al. | 482/54 |
| 5,690,587 | A * | 11/1997 | Gruenangerl | 482/54 |
| 5,800,314 | A | 9/1998 | Sakakibara | |
| 6,126,575 | A | 10/2000 | Wang | |
| 6,135,924 | A | 10/2000 | Gibbs | |
| 6,179,754 | B1 | 1/2001 | Wang | |
| 6,416,444 | B1 * | 7/2002 | Lim et al. | 482/54 |
| 7,094,180 | B2 | 8/2006 | Huang | |
| 7,101,319 | B1 | 9/2006 | Potts | |
| 7,115,076 | B2 * | 10/2006 | Oglesby et al. | 482/54 |
| 7,141,006 | B1 * | 11/2006 | Chen et al. | 482/54 |
| 7,153,241 | B2 | 12/2006 | Wang | |
| 7,220,219 | B2 * | 5/2007 | Papadopoulos et al. | 482/57 |
| 7,465,256 | B2 * | 12/2008 | Maenpaa | 482/54 |
| 7,507,187 | B2 * | 3/2009 | Dyer et al. | 482/54 |
| 7,618,346 | B2 * | 11/2009 | Crawford et al. | 482/8 |
| 2009/0036272 | A1 * | 2/2009 | Yoo | 482/7 |
| 2010/0210419 | A1 * | 8/2010 | Park | 482/7 |

* cited by examiner

*Primary Examiner* — Loan Thanh
*Assistant Examiner* — Sundhara Ganesan

(57) ABSTRACT

An improved treadmill control system which adjusts the speed of a moving tread belt to follow user motions. Equipment includes a tread base supporting a moving tread belt upon which a user can run or walk, a motor assembly and motor driver to move the tread belt, a plurality of foot sensors, a tread belt motion sensor, a measurement system to estimate user motion based on foot and tread belt sensor signals, and a motor controller to adjust motor assembly speed based on estimates of user motion. The system is capable of making improved user motion estimates and of using them to provide improved belt speed control. In one embodiment, user position, speed, and acceleration are estimated at each user footfall while estimates are continually revised between footfalls. In one embodiment, foot sensors are capacitive proximity sensors which are effective, fully concealable, and economical.

20 Claims, 22 Drawing Sheets

USER FOOTFALL SENSING CONTROL SYSTEM FOR TREADMILL EXERCISE MACHINES

CROSS-REFERENCE TO RELATED APPLICATIONS

Not Applicable

FEDERALLY SPONSORED RESEARCH

Not Applicable

SEQUENCE LISTING OR A COMPUTER PROGRAM

Not Applicable

BACKGROUND

1. Field

This disclosure relates to a control system for treadmill exercise machines with a fixed tread base and a moving tread belt upon which a user runs or walks. The disclosed device detects the position and time of user footfalls on the tread belt and adjusts tread belt speed to maintain the user's position relative to the fixed tread base.

2. Prior Art

Individuals commonly use treadmill exercise machines incorporating a moving belt over a tread base as a means of exercise similar to walking or running, but in a fixed location. Many users dislike using treadmill exercise machines, however. One reason is that they must manually set an exercise pace and then match that pace in order to stay safely centered on the tread base. This means of control is dissimilar to normal walking or running which allows the user to adjust speed semi-consciously in response to physical and mental state.

Several types of systems have been disclosed which measure the position of the user and automatically maintain the user's position on the tread base. These designs involve a variety of sensing means and control mechanisms. Despite these disclosures, the greatest majority of treadmill exercise machines do not incorporate automatically adjusted tread belt speed controls. The prior art has been commercially unsuccessful due to performance limitations and excessive production costs.

U.S. Pat. No. 4,708,337 issued to Shyu describes a treadmill speed control based on user body position sensing, preferably with an ultrasonic sensor, and incremental speed changes. However, accurate sensing of actual user position is complicated by the nature of human walking and running motion. Specifically, all portions of the user's body will be in relative motion with respect to the user's center of mass. This relative motion will vary from user to user and from one stride to the next for a single user. The result will be an unpredictable error in the user position control value of the disclosed systems. Control signal error is a principle limiter of performance in feedback control systems, often leading to instability. Additionally, incremental speed adjustments based on position zones or trigger lines result in slow, imprecise responses to user speed changes.

U.S. Pat. No. 5,314,391 issued to Potash describes infrared foot position sensors and also describes a proportional-integral control algorithm, based on a position control variable. The specification includes no detail of the foot sensors or a means of using them to determine user position. However, in-so-far as they protrude above the tread belt level, they may be perceived as non-aesthetic, they may be subject to obstruction by dirt or other objects, and they may be subject to damage due to their exposed position. The proportional-integral control system will be comparatively slow to respond to user speed changes because it employs user position relative to the tread base as the only feedback control variable. User position will only change gradually when the user changes speed. Control signal delay is a principle limiter of performance in feedback control systems.

U.S. Pat. No. 5,368,532 issued to Farnet describes an automatic treadmill speed control system incorporating two under-belt pressure sensors. Speed control is based on the sequence of sensor activations which can produce a positive, a negative, or a zero acceleration of the belt. The fixed acceleration rates of this system are common in the prior art. However, fixed acceleration rates are a crude form of control which severely limits the responsiveness of belt speed to changes in user motion. Further, the control algorithm is subject to many forms of error based on variation in user stride styles, user exercise rates, and user size. Pressure sensors may also be expensive and subject to excessive wear.

A system for automatic control of tread belt speed based on the position of the user has been disclosed in U.S. Pat. No. 5,800,314 issued to Sakakibara. The system described incorporates similar control and sensing features to earlier disclosures and shares their weaknesses. The system also provides a manual control allowing the user to change control system parameters. However, the system supports manual user selection from only two possible configurations via a mode setting switch. A manual selection may be inconvenient or confusing to the user. Further, two configurations may not allow for optimum control system performance in all modes of use. Finally, manual selection of control system parameters may not be a practical means to optimally set parameters for all operating conditions.

U.S. Pat. No. 6,135,924 issued to Gibbs discloses an automatic treadmill speed control similar to earlier systems but introducing an optical position sensor and calibration system. This new sensor type will suffer from the same unpredictable sensing errors as other whole-body sensing methods, and thus will not provide an acceptable performance.

A device for sensing the position of the user's feet on a jogging machine stepping board is disclosed in U.S. Pat. No. 7,094,180-B2 issued to Huang. However, the large number of sensors required to achieve reasonably accurate measurements limit economic viability, reliability, and performance of the disclosed system. The disclosure does not describe any specific sensor technology, mechanism for translation of sensor signals to speed control, or explanation for the edge placement of sensors. However, the edge placement of sensors increases the total number of sensors required and limits sensor accuracy.

The system disclosed in U.S. Pat. No. 7,094,180-B2 additionally claims to determine the speed of the user by measuring the width and time of a jogger pace between the contact positions and lift positions of two feet. However, the method disclosed will measure the average speed of the belt rather than the intended speed of the jogger. Thus the disclosed system will not provide an acceptable performance.

U.S. Pat. No. 7,101,319 issued to Potts discloses a three sensor under-belt foot sensing control systems to address problems of two sensor systems. However, the system described is still a fixed acceleration rate, zone-based system which will respond slowly and imprecisely to changes in user speed. It will also still suffer from performance variations due to variations in user size and user stride style.

U.S. Pat. Nos. 6,126,575, 6,179,754-B1, and 7,153,241-B2, issued to Wang, describe a range of linear above-belt non-touch sensor arrangements to detect foot position for the purpose of tread belt speed control. The disclosures describe no means to convert individual user foot detections for tread belt speed control. Specifically, the disclosures make no mention of the behavior of the disclosed system as a user's foot moves backward upon the tread belt and while no other footfall has yet been made upon the tread belt. Also, the disclosure includes no description of system performance while no user foot is in contact with the belt, as when running. These omissions limit the ability of one skilled in the art to use the disclosed devices in practical applications.

U.S. patent application Ser. No. 11/989,729 describes a treadmill speed control system incorporating forward and rearward mounted strain gauges. The disclosed system uses relative mechanical strain at these locations to estimate user position on the tread base. Resulting values will vary unpredictably based on user running style due to torques from user impact with the tread deck. Moreover, the system describes no means to estimate user position as the user's feet impact upon, translate upon, and leave the running surface during the course of a running or walking stride. Further, the disclosed sensors may be expensive and subject to excessive wear.

Within the prior art, no means are described to distinguish between an intentional foot placement versus an inadvertent or near foot placement on the tread belt. This might occur when the user drags a foot on or just above the belt while striding. The dragged foot may be detected by the various sensors described and consequently be used to control belt speed. Such erroneous reading will result in large and unpredictable error signals which will disrupt the operation of any speed control system.

The prior art also lacks any means to determine foot position more precisely than the spacing of foot sensors. This shortcoming reduces system performance for any sensor arrangement, or alternately, increases system cost for any desired performance level.

SUMMARY

In accordance with one embodiment, a control system measures the position of user footfalls on a tread belt of a treadmill exercise machine and employs the measurements to adjust tread belt speed. The control system adjusts tread belt speed in such a way as to keep the user appropriately positioned on the tread base as he or she changes speed relative to the tread belt. The control system incorporates improved means of sensing foot position as well as improved means of using foot position measurements to control tread belt speed.

DRAWINGS

DRAWINGS - List of Reference Numbers

| | | | |
|---|---|---|---|
| 100 | Treadmill Exercise Device | 102A | Forward-Most Foot Sensor Element |
| 102A-G | Foot Sensor Elements | 104 | User Input Device |
| 106 | Tread Belt | 108 | Tread Base |
| 202A | Roller - Rear | 202B | Roller - Front |
| 210 | Motor Drive Assembly | 214 | Belt Speed Sensor |
| 216 | Motor Driver | 218 | Motor Controller |
| 222 | User Motion Estimator | 226 | Foot Detector |
| 302 | Stride Calculator | 304 | User Speed Calculator |
| 306 | User Position Calculator | 308 | Sensor Filter |
| 310 | Footfall State Machine | 312 | Event Generator |
| 401 | Initial State Transition | 402 | Clear-tread State |
| 404 | Tread-active State | 405 | Self Transition |
| 406 | Footfall-located State | 408 | Footfall-confirmed State |
| 410 | Fault State | 604 | Timer |
| 606 | Stride Time Sum | 607 | Timer |
| 608 | Stride Travel Integrator | 610 | Stride Travel Sum |

-continued

| DRAWINGS - List of Reference Numbers | | | |
|---|---|---|---|
| 612 | Location Travel Integrator | 614 | Reset Delay |
| 701 | Delay | 702 | Previous Footfall Latch |
| 704 | Footfall Difference Sum | 706 | Footfall Position Latch |
| 708 | Footfall Position Sum | 710 | Sensor Position Converter |
| 802 | Comparison Position Computation | | |
| 804 | Most-Rearward Sensor Filter | 806 | Forward Interval Test |
| 807 | Guard Interval Test | 808 | Pass Filter Assignment |
| 810 | Block Filter Assignment | 812 | Rearward Interval Test |
| 901 | Wait Process | 902 | INIT Test |
| 904 | Zero Action | 906 | Measured Speed Calculation |
| 908 | Acceleration Calculation | 910 | Speed Calculation |
| 1002 | Set Speed Law | 1003 | Control Law Selector |
| 1004 | Acceleration Gain | 1006 | Speed Gain |
| 1008 | Control Signal Sum | 1010 | Position Gain |
| 1012 | Saturation Limiter | 1014 | Position Integral Gain |
| 1016 | Latched Speed Control Law | 1018 | User Motion Response Control Law |
| 1020 | Differentiator | 1022 | Acceleration Sum |
| 1026 | Acceleration Fault Switch | 1028 | Speed Fault Switch |
| 1030 | Speed Deviation Integrator | 1032 | Position Fault Switch |
| 1034 | Position Integral Fault Switch | 1035 | Zero Value |
| 1036 | Position Deviation Integrator | 1038 | Position Sum |
| 1040 | Acceleration Integrator | 1042 | Reset |
| 1102B-D | Detection Zone Limits | 1103 | User Foot |
| 1202 | User Foot | 1204 | User Foot |
| 1206 | User Foot | 1208 | User Foot |
| 1210 | User Foot | 1402 B-D | Modified Foot Sensors |
| 1404B-D | Modified Detection Limits | 1405 | User Foot |
| 1406B-D | Expanded Detection Limits | 1407 | User Foot |
| 1502 | Gain Control | 1802 | Modified Footfall-located State |
| 1902 | Modified Detection Limit | 1903 | User Foot |
| 1904 | Modified Detection Limit | 1905 | User Foot |
| 1906 | Modified Detection Limit | 1907 | User Foot |
| 2002 | Fractional Multiplier | | |

DETAILED DESCRIPTION

First Embodiment—FIG. 1 to FIG. 11

Figure 1:
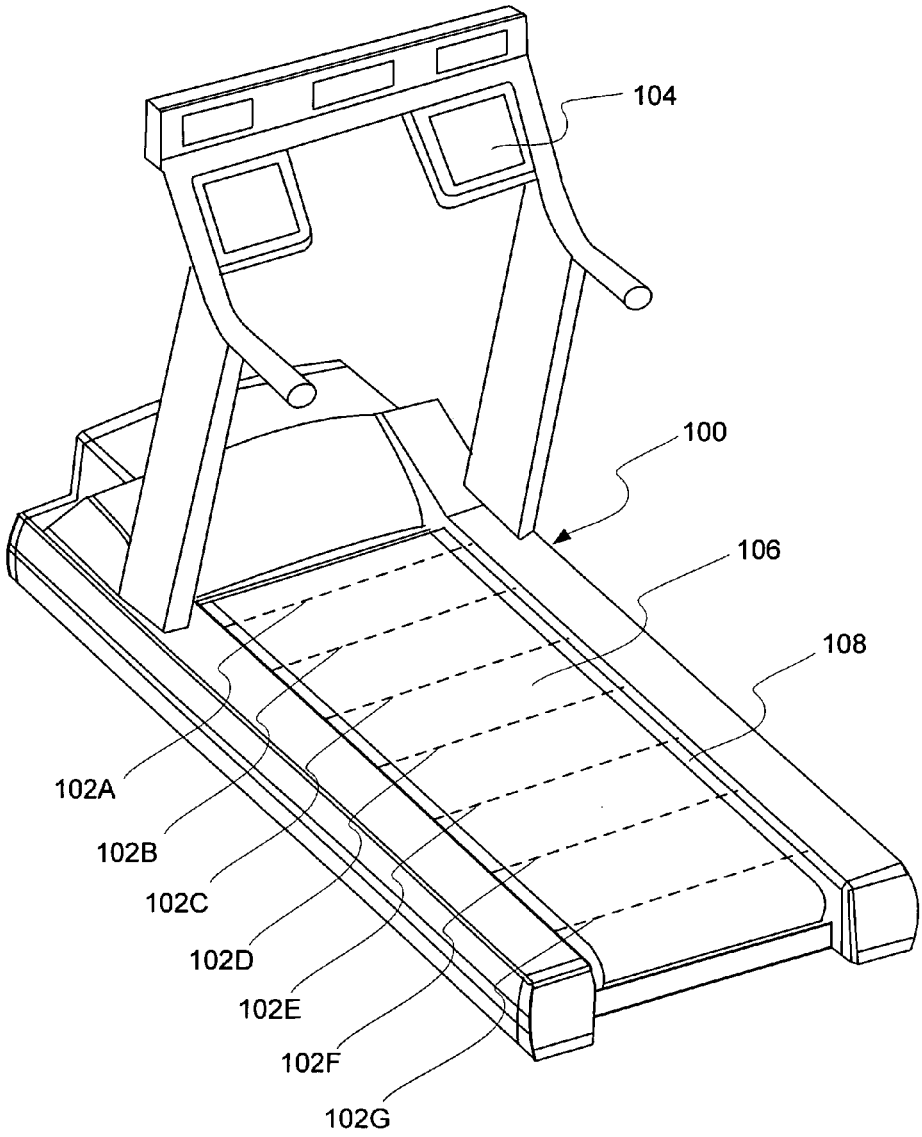
FIG. 1 shows the physical form of one embodiment of a treadmill exercise machine with foot position sensors.

FIG. 1 shows the basic appearance of an exercise treadmill device 100 according to a first embodiment. Treadmill 100 includes a user input device 104. Treadmill 100 also includes a series of foot sensor elements 102A to 102G, spanning the width of a tread base 108. A tread belt 106 lays on top of tread base 108 and forms a continuous loop extending beneath tread base 108. A user of treadmill 100 would walk or run on top of tread belt 106 in the direction facing toward input device 104 as the top surface of tread belt 106 moves rearward.

Figure 2:
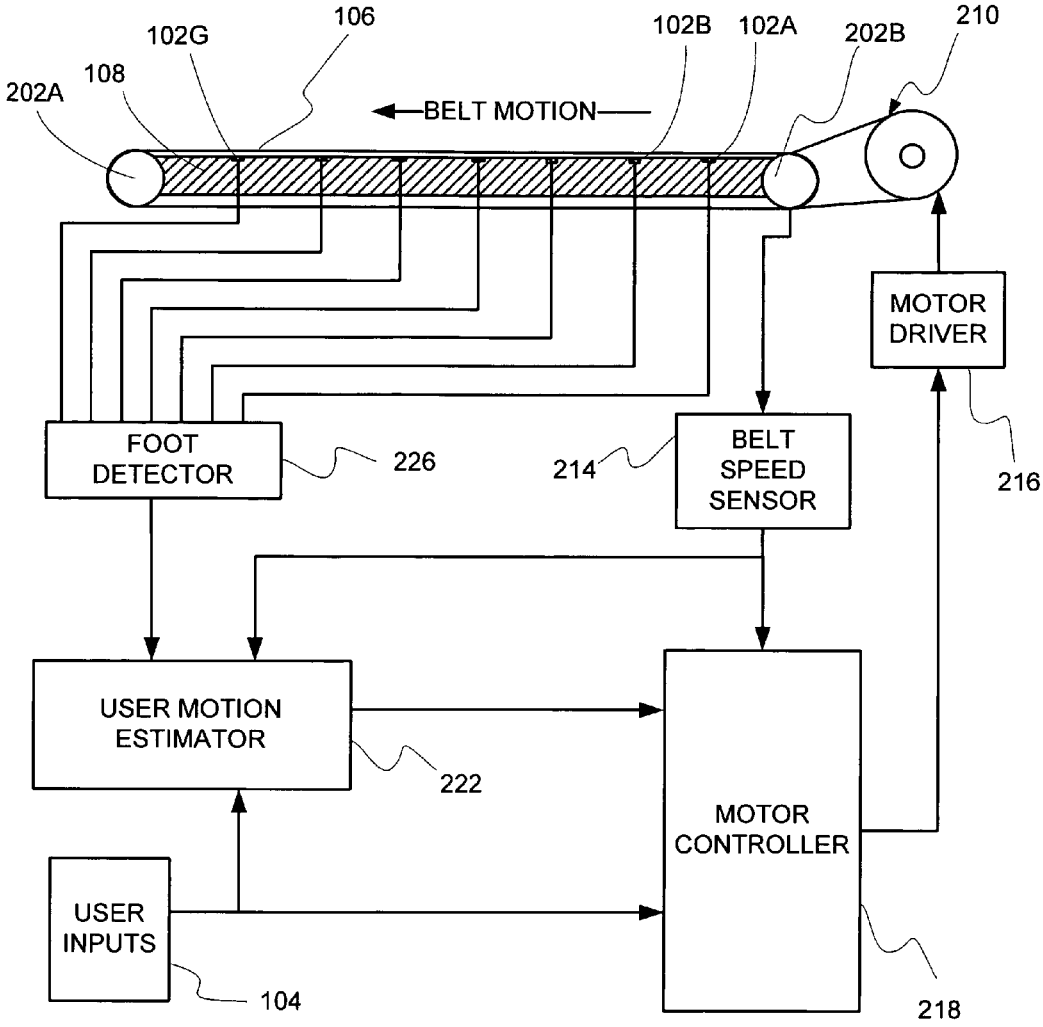
FIG. 2 shows a user footfall sensing control system for treadmill exercise machines of one embodiment.

System Block Diagram—FIG. 2

FIG. 2 is a system block diagram representing the treadmill control system of one embodiment. Unless otherwise indicated, components of the system block diagram may be implemented as hardware devices, software routines, or employing any other type of compute mechanism that successfully implements the defined operations. The information values, which may also be called signals, states, or variables, which pass between system components may be conveyed by software variables, electronic signals or any other way that successfully communicates the indicated information.

Foot sensors 102A to 102G of one embodiment are electrical conductors embedded in the upper surface of tread base 108. Tread belt 106 forms a continuous loop passing over a rear roller 202A and a front roller 202B. Roller 202B is driven by a motor drive assembly 210 causing a variable rate of motion of tread belt 106 relative to tread base 108.

A belt speed sensor 214 produces a belt speed signal representing the rate of motion of tread belt 106 relative to tread base 108.

Each of foot sensors 102A to 102G passes a signal to a foot detector 226. Foot detector 226 uses changes in capacitive properties of the foot sensors 102A-G to sense the proximity of the user's feet to each foot sensor 102A-G. Such capacitive proximity sensing techniques are commonly employed in computer touch screens, household appliance controls, and in automotive occupant sensing devices among other applications. Foot detector 226 produces a set of sensor states corresponding to the several foot sensors 102A-G. Each sensor state in the set of foot sensor states is true if a user's foot is in close proximity to the corresponding sensor and is false otherwise.

Input device 104 produces signals related to choices made by the user. A first signal produced by input device 104 is a control mode. In one embodiment, one control mode value represents a manual mode of operation where the system of FIG. 2 runs the tread belt at a user-chosen speed. Another control mode value represents an automatic mode of operation where the system of FIG. 2 sets tread belt speed based on estimated user motion. A second signal produced by input device 104 is a reset signal representing the user's wish to clear a current fault or error condition. A third signal represents a preset speed at which tread belt 106 should move when in a manual operating mode. A fourth signal represents a footfall target which is the position on tread base 108 where the user wishes to make footfall during exercise. In some embodiments the footfall target may be fixed, in others it may be user selectable, and in still others it may be automatically adjusted during operation of treadmill 100.

A user motion estimator 222 produces estimates of user motion. Motion estimates are based on foot sensor states from foot detector 226, the belt speed signal from sensor 214, and the reset signal from input device 104. Motion estimator 222 estimates the position of the user's most recent footfall, the speed of the user with respect to tread belt 106, and the acceleration of the user with respect to tread belt 106. Motion estimator 222 also generates a number of system state signals.

Motion estimator 222 identifies user footfalls, distinguishing true footfalls from other circumstances where the user's feet may be detected in proximity to foot sensors 102A-G. The timing and position of confirmed user footfalls, combined with the measured speed of tread belt 106, form the basis of motion estimator 222 outputs.

A motor controller 218 receives the signals generated by motion estimator 222 as well as the several control signals generated by input device 104. Motor controller 218 uses these inputs to produce a motor control signal related to the desired motion of tread belt 106. A motor driver 216 converts the motor control signal from motor controller 218 to a power signal that drives motor assembly 210.

Figure 3:
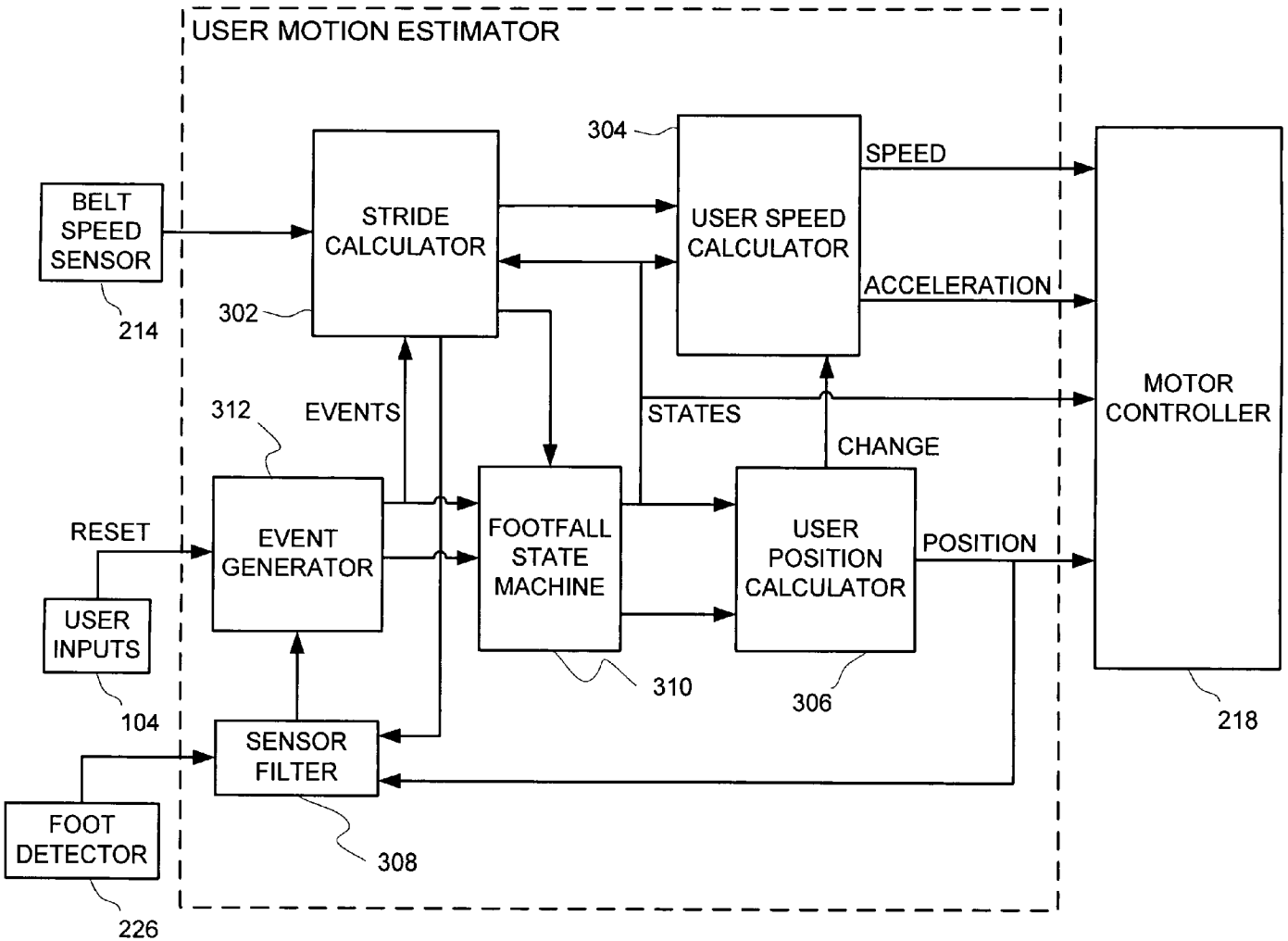
FIG. 3 shows a user motion estimator system block diagram of one embodiment.

User Motion Estimator—FIG. 3

FIG. 3 is a system block diagram of one embodiment of motion estimator 222 of FIG. 2.

A sensor filter 308 selectively processes foot sensor states received from detector 222. Filter 308 will either pass or block each current foot sensor value. Passed sensor states will be delivered unchanged to an event generator 312 while blocked states will always be inactive. Filter 308 uses position values from a user position calculator 306 and landed foot travel values from a stride calculator 302. The operation of filter 308, in combination with the operation of other system components, serves to separate true footfall detections from other sensor activations. The operation of filter 308 is described in FIG. 8.

Event generator 312 produces a number of signals representing events which are useful to trigger actions by other components. The various events are described in FIGS. 5A to 5F. Additionally, event generator 312 determines a forward sensor value which indicates the forward-most of sensors 102A-G which is in an active filtered sensor state. The events produced by event generator 312 are derived from the output of filter 308 and the reset signal from inputs 104.

A footfall state machine 310 interprets sequences of events produced by generator 312 to track user foot motions. State machine 310 provides a number of state signals to other system components which are true when state machine 310 is in the corresponding state and false otherwise. State machine 310 also generates a first sensor signal whose value represents the forward-most of sensors 102A-G activated in the current user stride.

Additionally, state machine 310 generates a travel signal representing the distance traveled by a user's foot from the time it activates the most forward sensor of a footfall and the time it clears the most forward sensor. Location of a user footfall between foot sensors depends upon the travel output value of state machine 310. The travel output signal of state machine 310 is derived from the location travel signal received from a stride calculator 302.

Stride calculator 302 produces four measurements related to user strides. Location travel represents the distance traveled by tread belt 106 since the most recent more forward event. More forward events are defined in FIG. 5B. Stride travel represents the distance along belt 106 spanned by the most recent user stride. Stride time represents elapsed time during the most recent user stride. Landed foot travel represents the distance traveled by belt 106 since the most recent confirmed user footfall. Stride calculator 302 uses the state signals produces by state machine 310, the event signals produces by event generator 312, and the belt speed signal produced by sensor 214.

User position calculator 306 produces estimates of user position along tread base 108. The position signal represents the forward-most extent of the user's foot at each new footfall. This position generally corresponds to the tip of the user's toes at footfall. Position calculator 306 also determines a change value which is the difference between the latest position estimate and the previous position estimate. Position calculator 306 uses the footfall-confirmed, travel, and first sensor signals produced by state machine 310.

A user speed calculator 304 produces estimates of user speed and user acceleration relative to belt 106. Speed calculator 304 makes new estimates each time state machine 310 reports a confirmed user footfall. Speed calculator 304 uses the stride time signal from stride calculator 302, the belt travel signal from stride calculator 302, the footfall-confirmed signal from state machine 310, and the change signal from position calculator 306.

Figure 4:
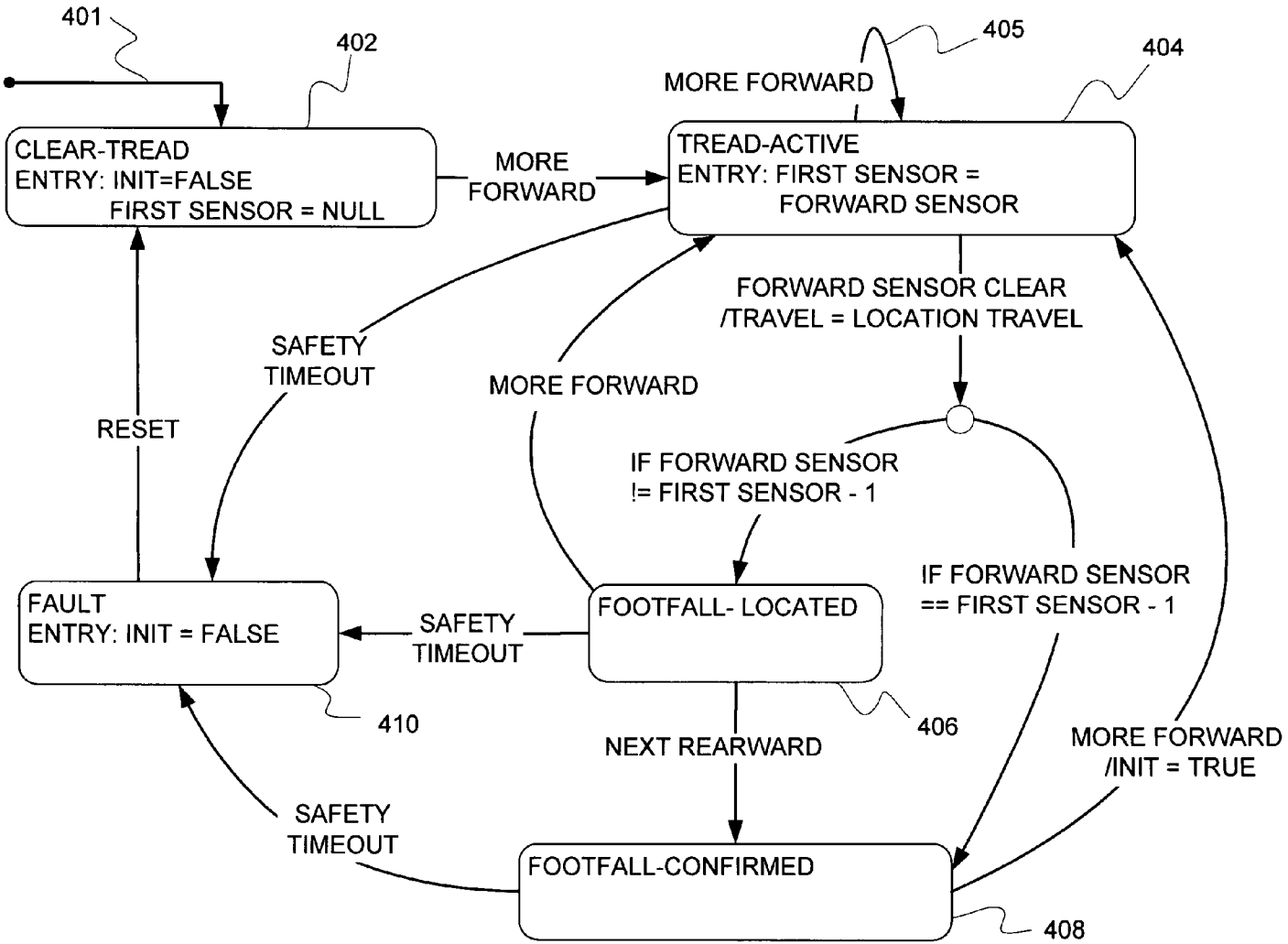
FIG. 4 shows a footfall state machine state transition diagram of one embodiment.

Footfall State Machine—FIG. 4

FIG. 4 is a state diagram of one embodiment of state machine 310 of FIG. 3. The state machine of FIG. 4 provides one means to detect instances of user footfalls upon tread belt 106. The machine of FIG. 4 distinguishes actual footfalls from other situations in which sensors 102A-G detect the proximity of a user's foot.

The state diagram of FIG. 4 conforms to common conventions for representation of Mealy state machines where the future state of the machine depends upon its current state and upon its inputs. A state machine such as state machine 310 may be realized in many different ways using existing technology. One common method is to implement a state machine as software running on a micro-controller. Another common method is to implement a state machine with configurable hardware such as a complex programmable logic device or field programmable gate array. Other methods are also commonly used.

FIG. 4 shows that state machine 310 begins operation by entering a clear-tread state 402 via an initial state transition 401. Clear-tread state 402 executes entry actions each time the state is entered. One entry action sets the value of init to false indicating that the system is not initialized. Another entry action sets the value of first sensor to null indicating that no forward-most sensor has been identified. FIG. 4 shows that state machine 310 will remain in clear-tread state 402 until a more forward event is received, whereupon the system will transition to a tread-active state 404.

Tread-active state 404 executes an entry action each time the state is entered. The entry action assigns the current value of the forward sensor input to the first sensor output signal. Therefore, first sensor represents the identity of the most forward of sensors 102A-G in a filtered active state at the time state machine 310 most recently entered tread-active state 404.

If state machine 310 receives a more forward event while in tread-active state 404, the state machine reenters tread-active state 404 via a self transition 405 and the state's entry action executes again.

If state machine 310 receives a forward sensor clear event while in tread-active state 404, the state machine assigns the value of the location travel input signal to the travel output signal. The system then transitions to one of two states depending upon the current value of the forward sensor input signal. If forward sensor is one less than first sensor, state machine 310 enters a footfall-confirmed state 408. In this case, a user footfall is confirmed by the pattern of sensor activations. Otherwise, state machine 310 enters a footfall-located state 406. In this case, a user footfall may have been detected by the pattern of sensor activations but the footfall is not yet confirmed.

If state machine 310 receives a more forward event while in footfall-located state 406, the state machine transitions to tread-active state 404. In this case, the previous sensor activation pattern did not represent a user footfall.

If state machine 310 receives a next rearward event while in footfall-located state 406, the state machine transitions to footfall-confirmed state 408. In this case a user footfall has been confirmed by the pattern of sensor activations.

If state machine 310 receives a more forward event while in footfall-confirmed state 408, the state machine transitions to tread-active state 404. At the time of the transition, INIT is set to true indicating that the system is now initialized.

If state machine 310 receives a safety timeout event while in any of tread-active state 404, footfall-located state 406, or footfall-confirmed state 408, the state machine transitions to a fault state 410. The entry action of fault state 410 sets the INIT output signal to false indicating that the system is no longer initialized.

If state machine 310 receives a reset event while in fault state 410, the state machine will transition to clear-tread state 402 and that state's entry actions will be executed.

Event Generator—FIGS. 5A to 5F

Event generator 312 of FIG. 3 produces a forward sensor signal and a number of events related to user foot motions. Event generation is based on sensor values from filter 308 of FIG. 3.

Figure 5A:
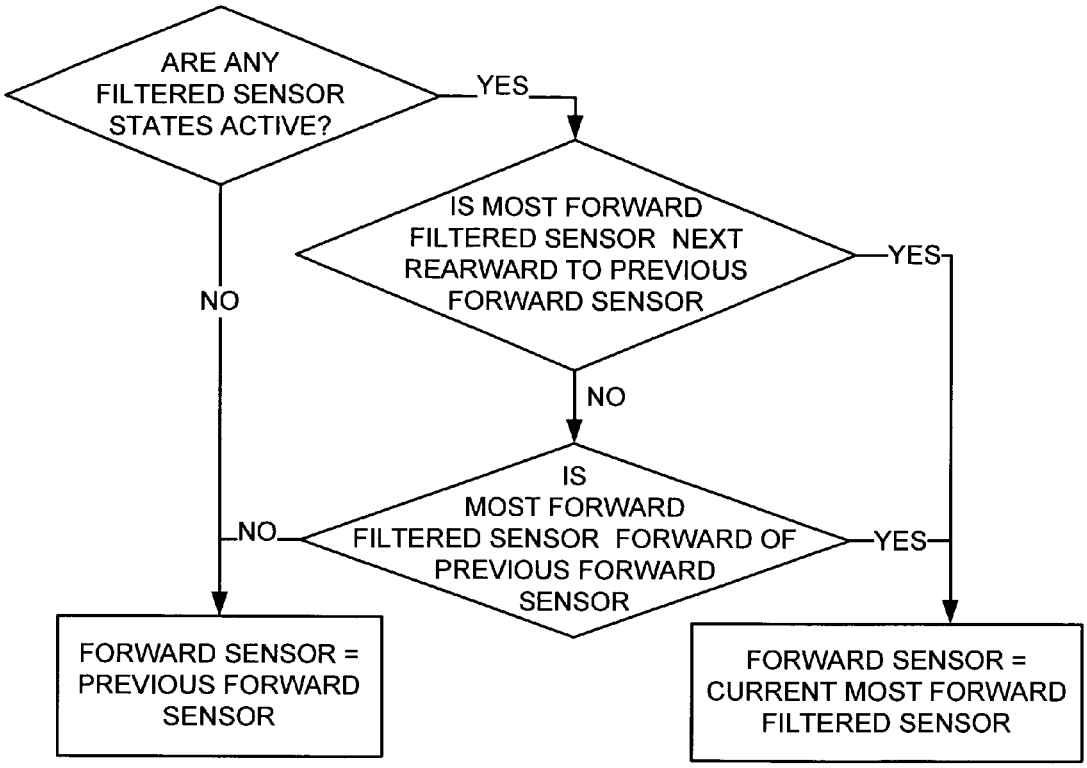
FIGS. 5A-5G show event generator flow charts of one embodiment.

The forward sensor signal represents the identity of the forward-most currently active of foot sensors 102A-G. FIG. 5A shows a flow chart of the method used to determine the forward sensor signal value. Event generator 312 only updates the forward sensor signal value under certain conditions. Generator 312 retains the previous most forward value if the user's foot is currently between two sensors and therefore has not activated any sensor. Generator 312 also retains the previous most forward value if the new value would be more than one sensor position rearward of the current forward sensor value. This criterion prevents a user's rearward foot from interfering with evaluation of a new footfall when a user is walking on tread belt 106 or for any other reason has more than one foot in contact with tread belt 106 at the same time. Generator 312 must generally determine the identity of the forward sensor before it carries out operations represented by FIGS. 5B to 5F. Several of the criteria for events produced by generator 312 reference the updated value of forward sensor.

FIGS. 5B to 5F define the event production criteria of event generator 312. Events are transient conditions which are detected and reported for the purpose of triggering actions such as clearing counters, latching data values, and performing calculations. Events may be realized in many different ways using existing technology. One common method is to implement an event as a boolean software variable where the event is defined as the transition from the false to the true state. Another common method is to implement an event as a bi-stable electrical signal where the event is defined as the rising or falling edge of the signal's voltage waveform. Other methods are also commonly used.

Figure 5B:
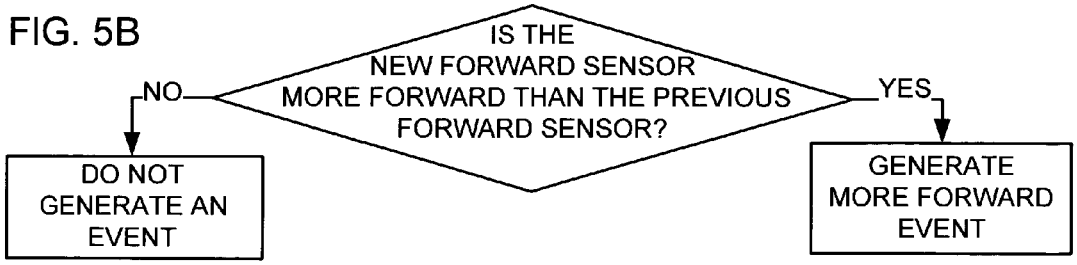

FIG. 5B defines the criterion for generating a more forward event, indicating that the new forward sensor is more forward on tread base 108 than the previous forward sensor.

Figure 5C:
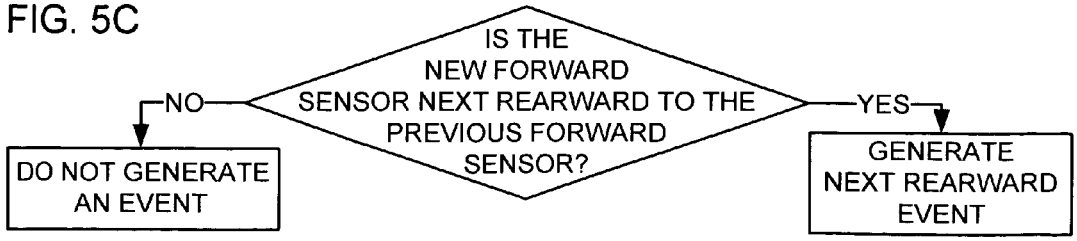

FIG. 5C defines the criterion for generating a next rearward event, indicating that the new forward sensor is the next more rearward on tread base 108 to the previous forward sensor.

Figure 5D:
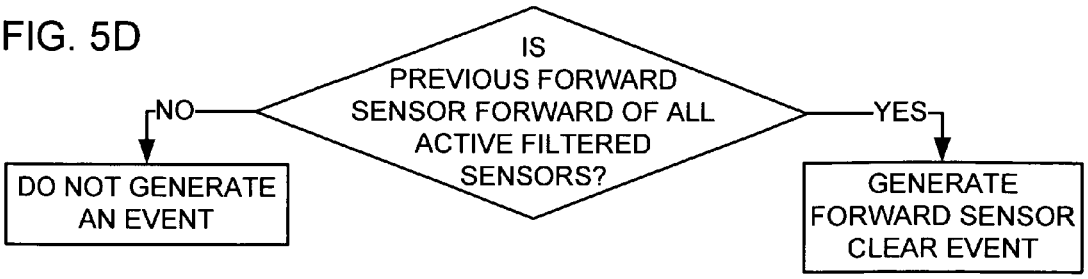

FIG. 5D defines the criterion for generating a forward sensor clear event, indicating that the previous forward sensor is forward of all currently active sensors.

Figure 5E:
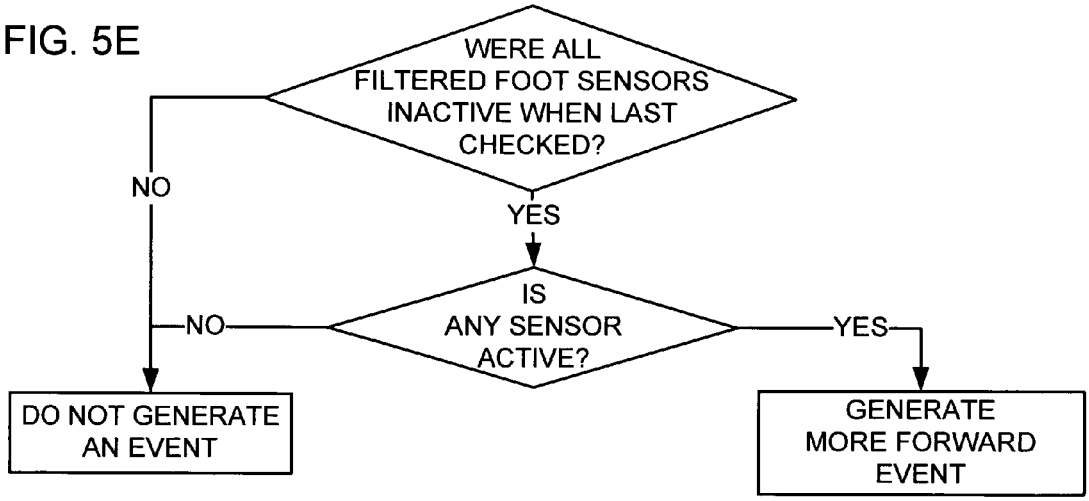

FIG. 5E defines the criteria for generating a more forward event when all filtered sensors were previously inactive.

Figure 5F:
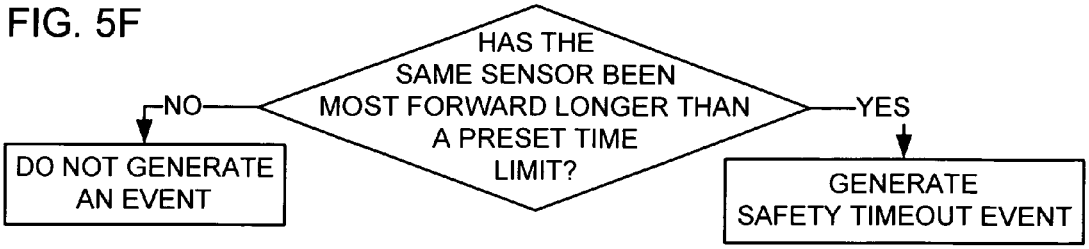

FIG. 5F defines the criteria for generating a safety timeout event, indicating that a single foot sensor has been the most forward sensor for more than a preset time limit.

Figure 5G:
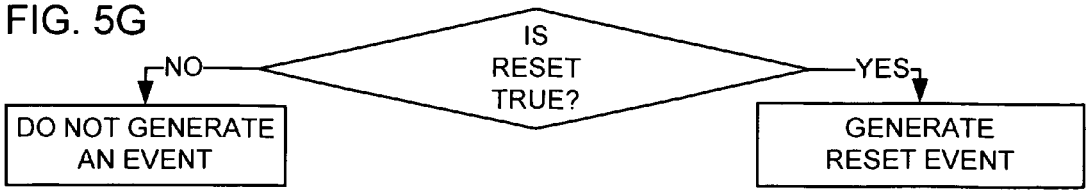

FIG. 5G defines the criteria for generating a reset event, indicating that the user has intervened to clear a fault condition.

Figure 6:
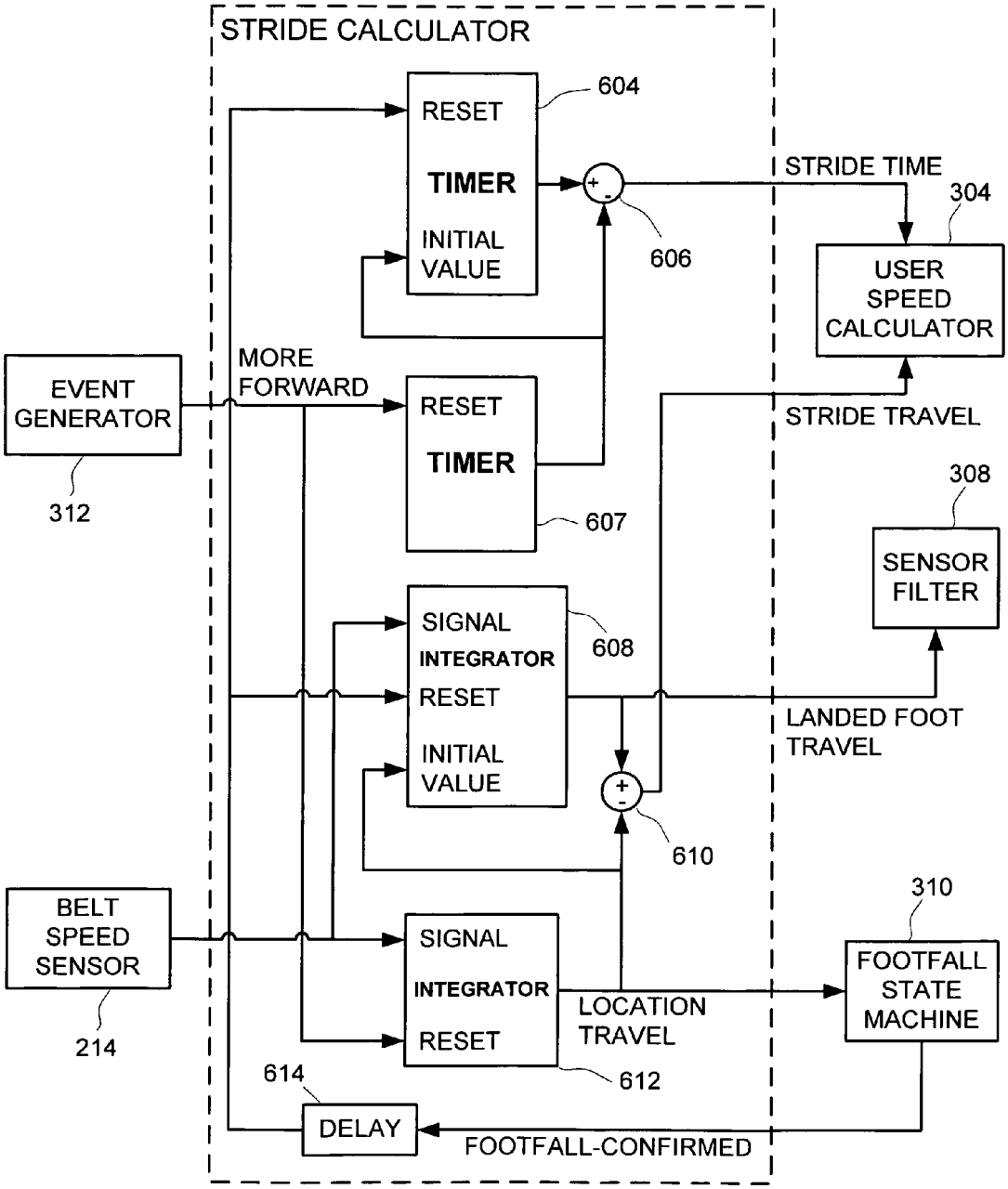
FIG. 6 shows a stride calculator system block diagram of one embodiment.

Stride Calculator—FIG. 6

FIG. 6 is a system diagram showing one embodiment of stride calculator 302 of FIG. 3. A stride is the user motion encompassing two consecutive footfalls on tread belt 106. Stride calculator 302 produces values representing stride travel, stride time, landed foot travel and location travel.

The calculations performed by stride calculator 302 may be realized in different ways using existing technology. One common method is to implement calculations as software running on a micro-controller. Another common method is to implement computations in configurable hardware such as a complex programmable logic device or field programmable gate array. Other methods are also commonly used.

Stride travel represents the distance along belt 106 spanned by the most recently completed user stride. Each footfall confirmed event resets a stride travel integrator 608 to the current value of location travel. At all other times, integrator 608 generates the time integral of the belt speed input value. A stride travel sum 610 subtracts the output of a location travel integrator 612 from the output of integrator 608 to produce the value of stride travel. Therefore, at the time a new footfall is confirmed, stride travel represents the total length of belt 106 spanned since the previous user footfall. The value of stride travel is valid as soon as the more forward event at the end of the current stride resets integrator 612. Stride travel remains valid until integrator 608 is reset by a confirmed footfall. A reset delay 614 ensures that calculations that use stride travel and which are triggered by footfall-confirmed signals may be completed while the value of stride travel remains valid. Delay 614 is necessary in embodiments such as electronic embodiments of stride calculator 302. In software embodiments, an appropriate order of instruction execution serves the purpose of delay 614.

Stride time represents the elapsed time during the most recently completed stride. The value of stride time is valid as soon as the more forward event ending the current stride resets a timer 607. Stride time remains valid until a footfall confirmed event resets a timer 604. A stride time sum 606 subtracts the output of timer 607 from the output of timer 604 to produce stride time. Reset delay 614 ensures that calculations using stride time which are triggered by a confirmed footfall may be completed while the value of stride time remains valid. Delay 614 is necessary in embodiments such as electronic embodiments of stride calculator 302. In software embodiments, an appropriate order of instruction execution serves the purpose of delay 614.

Landed foot travel represents the amount of belt travel since the most recent user footfall. Landed foot travel values are produced by the output of integrator 608 and are valid as soon as the footfall confirmed event at the beginning of a new stride resets integrator 608. Landed foot travel remains valid until the next footfall-confirmed event.

Location travel represents the amount of belt travel since the most recent more forward event. Each more forward event resets integrator 612 to zero. At all other times, integrator 612 generates the time integral of the belt speed input signal.

Therefore, at the time a user footfall is confirmed, location travel represents the distance traveled by the user's foot from the time it made footfall on tread belt 106. Measurement and appropriate use of location travel improves the accuracy of user speed and position estimates by locating the forward-most extent of user footfalls when they occurred between two of foot sensors 102A-G.

Figure 7:
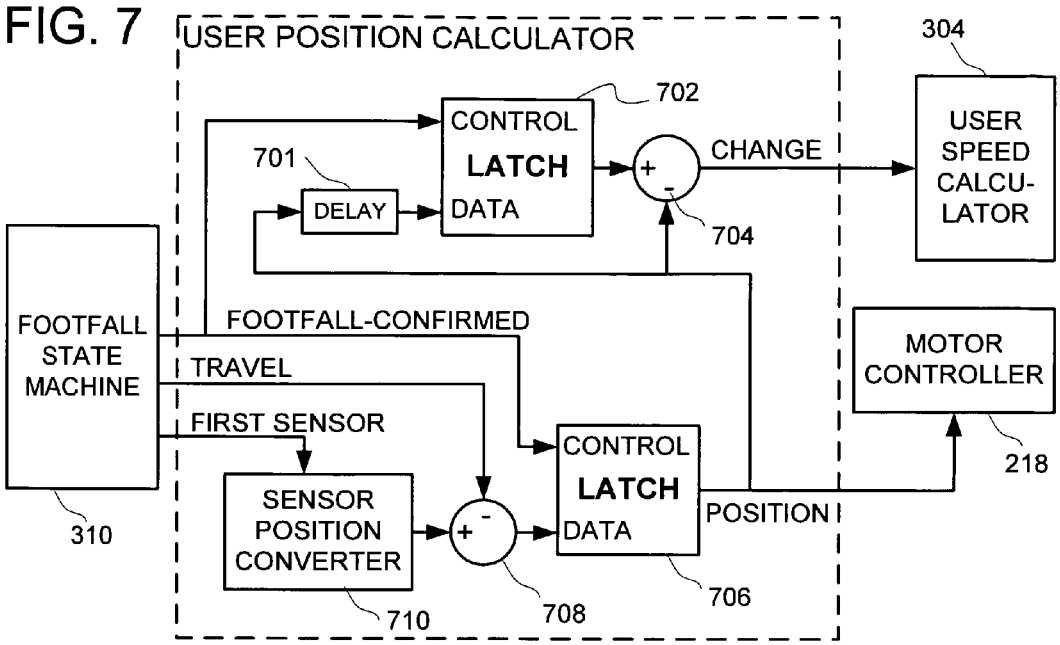
FIG. 7 shows a user position calculator system block diagram of one embodiment.

User Position Calculator—FIG. 7

FIG. 7 is a system diagram representing one embodiment of user position calculator 306 of FIG. 3. Position calculator 306 produces a position signal and a change signal. The position signal represents the position along tread base 106 of the forward-most extent of the user's most recent footfall. The change signal represents the difference between the two most recent values of position.

A sensor position converter 710 produces a value representing the distance between first sensor and the forward end of tread base 108. A footfall position sum 708 subtracts the value of travel from the output of converter 710. A latch 706 stores and holds the value from sum 708 each time footfall-confirmed state changes from false to true. Therefore, the position output of latch 706 represents the forward-most extent of the user's most recent footfall. The data input of a previous footfall latch 702 connects to the output of latch 706 via delay 701. Delay 701 ensures that latch 702 has time to load the output value of latch 706 before latch 706 begins to change its output value. Delay 701 is necessary in embodiments such as electronic embodiments of position calculator 306. In software embodiments, an appropriate order of instruction execution serves the purpose of delay 701.

When footfall-confirmed state becomes true, latch 702 and latch 706 each load new data values. Latch 702 preserves the value of position just before a new value is loaded into latch 706. A footfall difference sum 704 subtracts the value of position from the output of latch 702. Therefore, the value of change represents the difference between the two most recent values of position.

The values of position and change are valid as soon as a confirmed footfall causes latches 702 and 706 to load new data values. The values remain valid until the next user footfall is confirmed.

Figure 8:
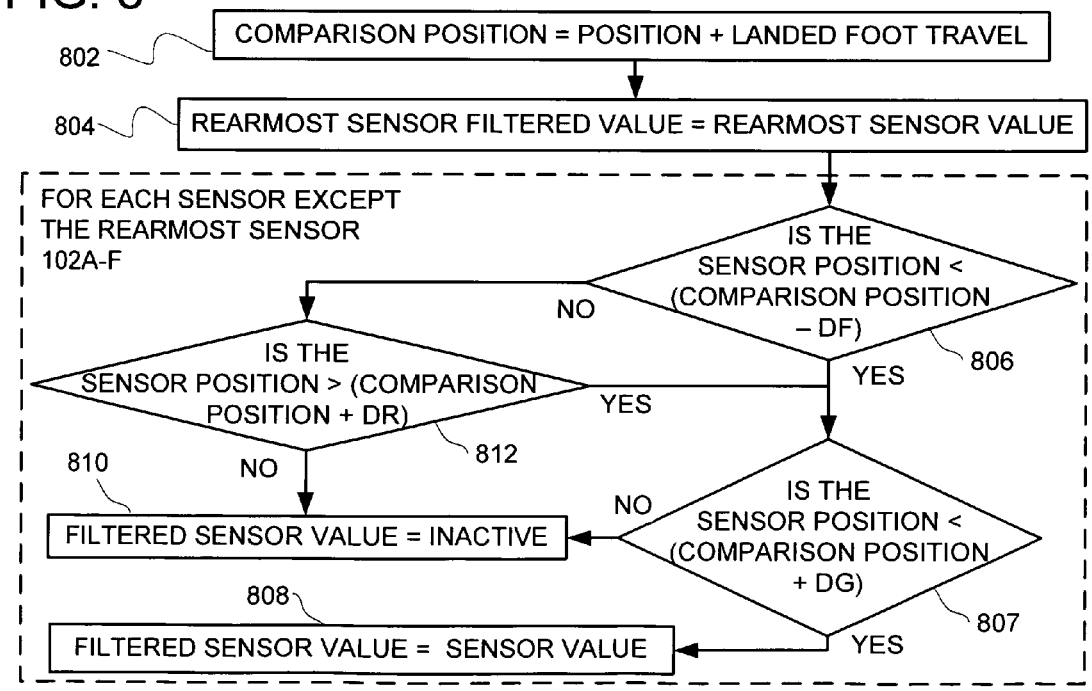
FIG. 8 shows a sensor filter flow chart of the embodiment.

Sensor Filter—FIG. 8

FIG. 8 is a flow chart representing one embodiment of sensor filter 308 of FIG. 3. A comparison position step 802 describes the generation of a comparison position value. The comparison position represents the estimated current forward-most extent of the user's last foot to fall on tread belt 106. This generally corresponds to the current location of the user's toes. Filter 308 selectively filters the values of the foot sensor states from foot detector 226 based on the position of each sensor, passing some sensor values and blocking others.

In one embodiment, a most rearward sensor filter step 804 always passes the value of rearmost foot sensor, 102G.

The remaining operations of FIG. 8 are performed for each of sensors 102A-F. A forward interval test 806 determines if the sensor's position is forward of an interval, DF, placing it ahead of the comparison position far enough to prevent activation of the next more forward sensor. A rearward interval test 812 determines if the sensor's position is rearward of an interval, DR, behind the comparison position. Sensor values are blocked for all sensors that meet neither of these criteria. Otherwise, a guard interval test 807 determines if the sensor's position is forward of an interval, DG, behind the comparison position. Sensor values are passed for all sensors that meet this criterion and blocked for all others. A pass filter assignment step 808 sets each passed sensor value to the corresponding unfiltered sensor value. A block filter assignment step 810 sets each blocked sensor value to inactive.

Forward interval DF enforces a one sensor gap between the landed foot and a newly detected foot, which is useful in preventing some types of footfall confirmation errors. Rearward intervals DR and DG prevent interference of a trailing foot with measurements of a leading foot in cases where the user has two or more feet in contact with tread belt 106 concurrently. This may occur in cases where the user is walking and in cases where the user is a dog, among other cases.

Figure 9:
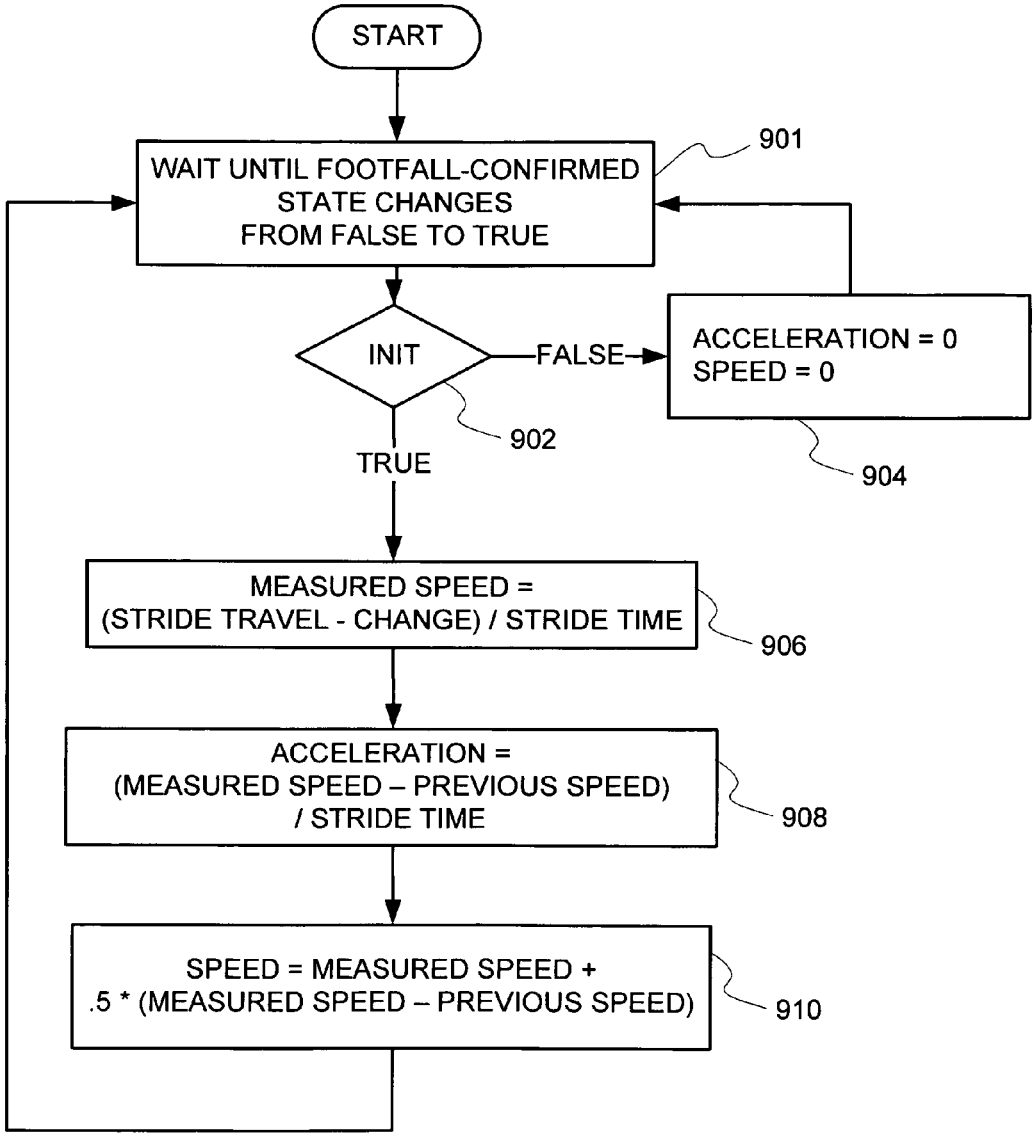
FIG. 9 shows a user speed calculator flow chart of one embodiment.

User Speed Calculator—FIG. 9

FIG. 9 is a flow chart representing one embodiment of user speed calculator 304 of FIG. 3. Speed calculator 304 produces estimates of user speed and acceleration based on inputs from stride calculator 302, footfall state machine 310, and user position calculator 306. A wait process 901 causes the remaining steps of FIG. 9 to produce a new set of estimates each time a user footfall is confirmed. An INIT test 902 causes a zero action step 904 to set speed and acceleration estimates to zero if the system is uninitialized. Otherwise, a measured speed calculation step 906 computes a preliminary estimate of user speed. Next, an acceleration calculation step 908 computes the user's acceleration between the two most recent speed measurements. Then a speed calculation step 910 computes a final estimate of user speed before calculator 306 returns to wait process 901.

Figure 10A:
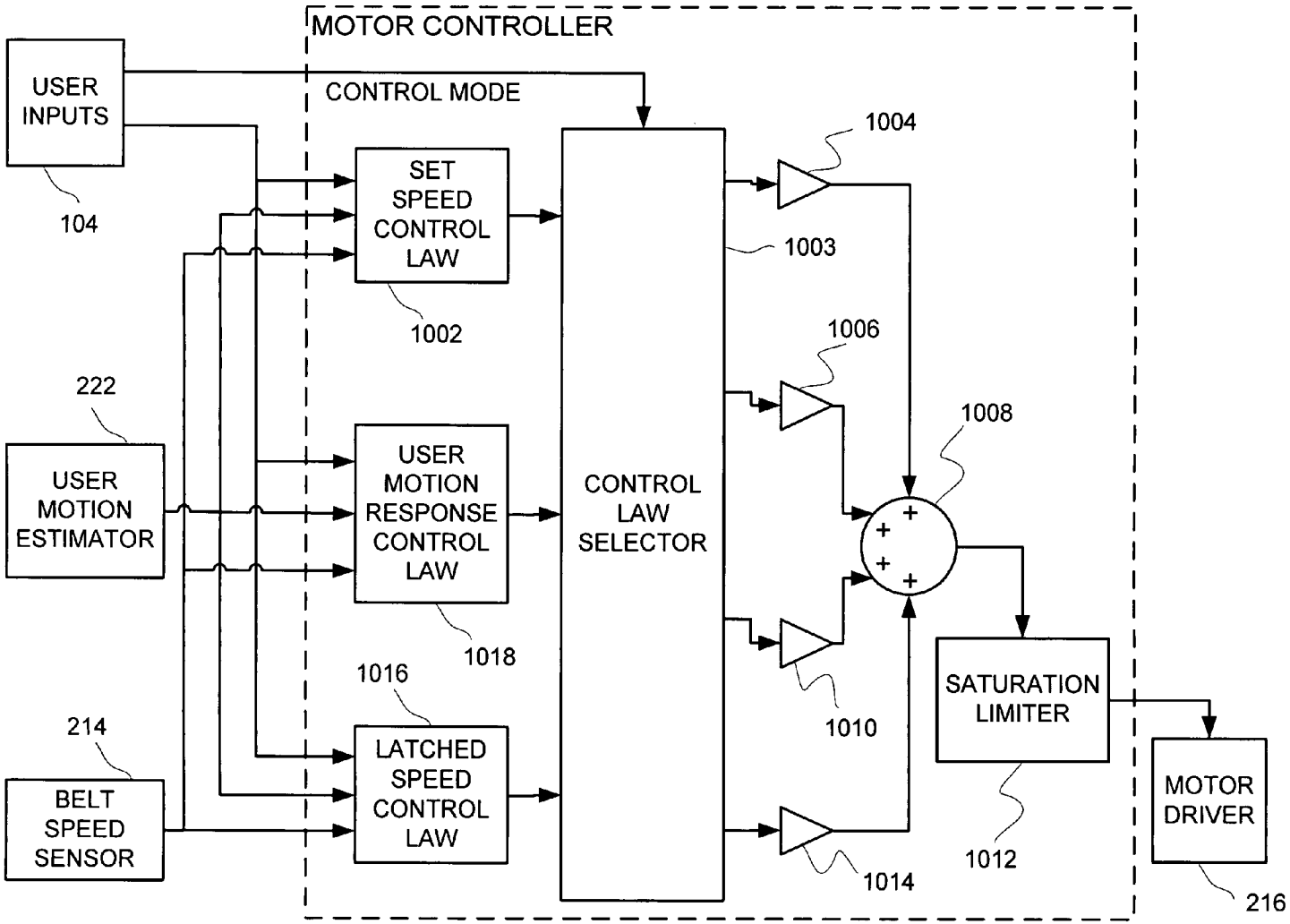
FIGS. 10A and 10B show a motor controller system block diagram of one embodiment.
Figure 10B:
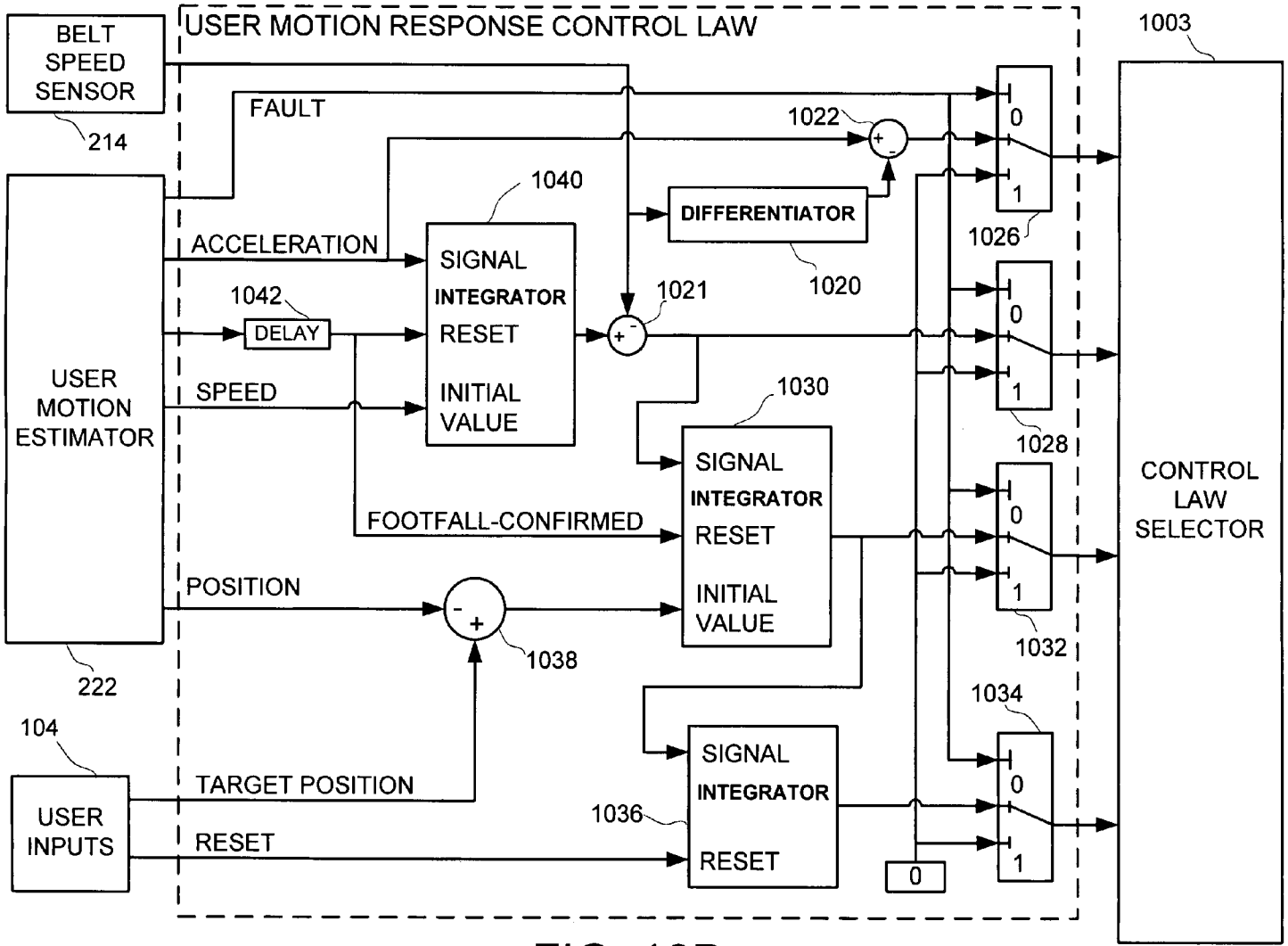

Motor Controller—FIGS. 10A and 10B

FIGS. 10A and 10B are system diagrams describing one embodiment of motor controller 218 of FIG. 2. Motor controller 218 produces a motor control signal to control the speed of tread belt 106 via motor driver 216 and motor assembly 210. FIG. 10A is a system block diagram showing one embodiment of motor controller 218 and its interfaces to the remainder of the control system. FIG. 10B is a system block diagram showing one embodiment of a user motion response control law 1018 and its interfaces.

FIG. 10A shows several control law components, each representing a mode of motor controller operation. Each control law receives information from user inputs 104, user motion estimator 222, and belt speed sensor 214. Each control law uses the information provided by these inputs to generate a continually updated set of four error values. Each error value represents the difference between a desired value and a measured value. The four error signals are acceleration error, speed error, position error, and the time integral of position error.

A set speed control law 1002 produces error signals intended to hold belt 106 at a preset speed selected by the user via user inputs 104. A latched speed control law 1016 produces error signals intended to hold belt 106 at a constant speed equal to the speed at the time the latched speed mode was selected. User motion response control law 1018 produces error signals intended to maintain the user's position on tread base 108 as the user changes speed during an exercise period.

FIG. 10A also shows a set of gain stages which adjust the influence of the error values on the final motor control signal. An acceleration gain 1004 adjusts the influence of acceleration error on the motor control signal. A speed gain 1006 adjusts the influence of speed error. A position gain 1010 adjusts the influence of position error. A position integral gain 1014 adjusts the influence of the integral of position error on the motor control signal.

A control law selector 1003 routes a set of error values from one of the several control law components to a set of gain stages. The operation of selector 1003 is based on a control mode signal from user inputs 104.

A control signal sum 1008 adds the four adjusted error values to produce an intermediate motor control signal. A saturation limiter 1012 restricts the final motor control signal, preventing motor driver 216 from receiving a control input greater or less than a predefined limit. Limiter 1012 prevents large signal values that might cause damage to power components of motor driver 216. Limiter 1012 also prevents control signal values that might cause unacceptable accelerations of belt 106.

FIG. 10B is a system block diagram showing one embodiment of user motion response control law 1018. Control law 1018 produces a set of four continually updated error signals intended to maintain user position on tread base 108.

A differentiator 1020 estimates the acceleration of belt 106 based on changes in the signal from belt speed sensor 214. An acceleration sum 1022 subtracts the output of differentiator 1020 from the user acceleration value provided by user motion estimator 222. If the fault state signal from estimator 222 is not set, an acceleration fault switch 1026 will route the acceleration error value from sum 1022 to control law selector 1003. If the fault state is set, switch 1026 will route a value of zero to selector 1003.

An acceleration integrator 1040 computes the time integral of user acceleration estimates. Integrator 1040 is initialized to the value of the current user speed estimate each time the system enters footfall-confirmed state 408. Thus, integrator 1040 projects user speed between confirmed footfalls by assuming a constant rate of user acceleration. An acceleration sum 1021 subtracts belt speed from the user speed estimate produced by integrator 1040 to create a speed error value. If the fault state signal is not set, a speed fault switch 1028 will route the speed error value from sum 1021 to control law selector 1003. If the fault state is set, switch 1028 will route a value of zero to selector 1003.

A speed deviation integrator 1030 computes the time integral of speed error values. Integrator 1030 is initialized to the value of the user position error each time the system enters footfall-confirmed state 408. Thus, integrator 1030 projects user position error between confirmed footfalls. If the fault state signal is not set, a position fault switch 1032 will route the position error value from integrator 1030 to control law selector 1003. If the fault state is set, switch 1032 will route a value of zero to selector 1003.

A delay 1042 delays the arrival of footfall-confirmed signals to integrator 1040 and integrator 1030. The delay ensures that any new calculations of speed and position have been completed before the integrators accept new initial values. Delay 1042 is necessary in embodiments such as electronic embodiments of control law 1018 in order to avoid race conditions. In software embodiments, an appropriate order of instruction execution serves the purpose of delay 1042.

A position deviation integrator 1036 computes the time integral of position error values. Integrator 1036 is initialized to zero each time a reset signal is received from user inputs 104. The position error integral value will have increasing influence on the motor control signal if a position error persists for an extended time and will tend to eliminate such steady state position errors. If the fault state signal is not set, a position integral fault switch 1034 will route the position error integral value from integrator 1036 to control law selector 1003. If the fault state is set, switch 1034 will route a value of zero to selector 1003.

When the fault state is set, all signals routed to selector 1003 from control law 1018 will have a value of zero and will thus tend to cause belt 106 to stop.

Figure 11A:
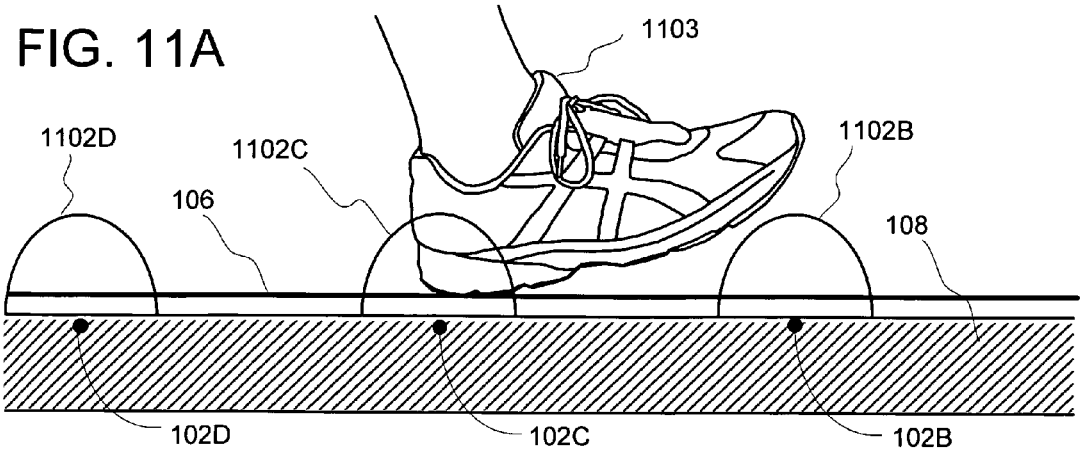
FIGS. 11A to 11C show operation of capacitive sensors during a typical user stride.

Capacitive Sensor—FIG. 1, FIG. 2, and FIG. 11A

In one embodiment, foot sensors 102A-G are capacitive sensors. Capacitive sensors detect the presence of conductive materials within a detection radius. Sensor elements generate an electric field and sensor electronics measure changes in that field over time. In the present embodiment, sensor electronics are contained within foot detector 226 of FIG. 2. Human tissue can be detected by capacitive sensors. FIG. 1 shows foot sensors 102A-G arranged along the length of tread base 108 with each sensor running the width of tread base 108. FIG. 11A shows a portion of treadmill 100 from the side, revealing foot sensors 120B-D to be wires used to generate an electric field for capacitive sensing. Around foot sensors 102B-D, FIG. 11A shows a set of detection zone limits 1102B-D defining the areas within which a user's foot will be detected. The geometry of detection zone limits 1102B-D are determined by the detailed design of foot sensors 102B-D, the detailed design of foot detector 226, and the arrangement of surrounding conductive materials.

In FIG. 11A, foot sensor 102C will produce an active sensor result because a portion of a user foot 1103 is within detection zone limit 1102C. However, foot sensors 102B and 102D will produce inactive sensor results because no conductive object is within detection zone limits 1102B or 1102D.

Capacitive sensors are advantageous for application in treadmill exercise machines because they are adaptable, they can be completely concealed within the tread base, they are sensitive to living tissue, and they can be implemented economically.

Operation

Figure 11B:
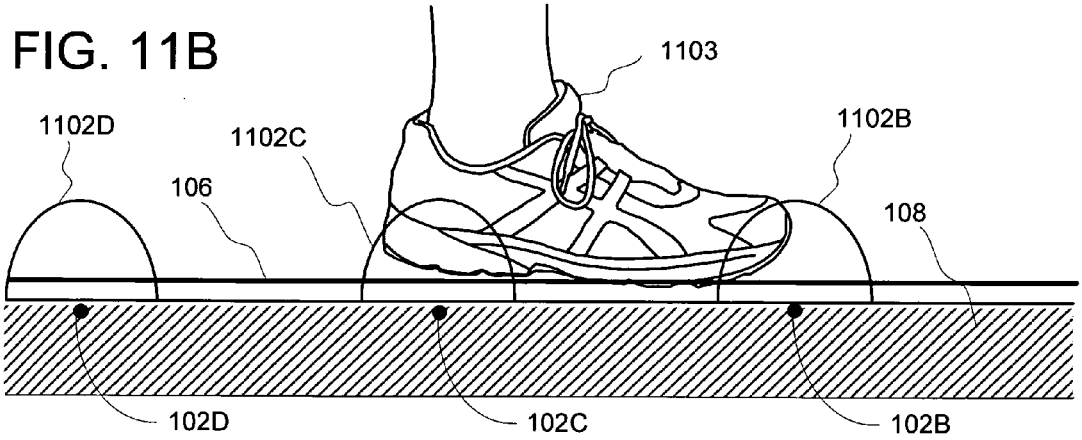
Figure 11C:
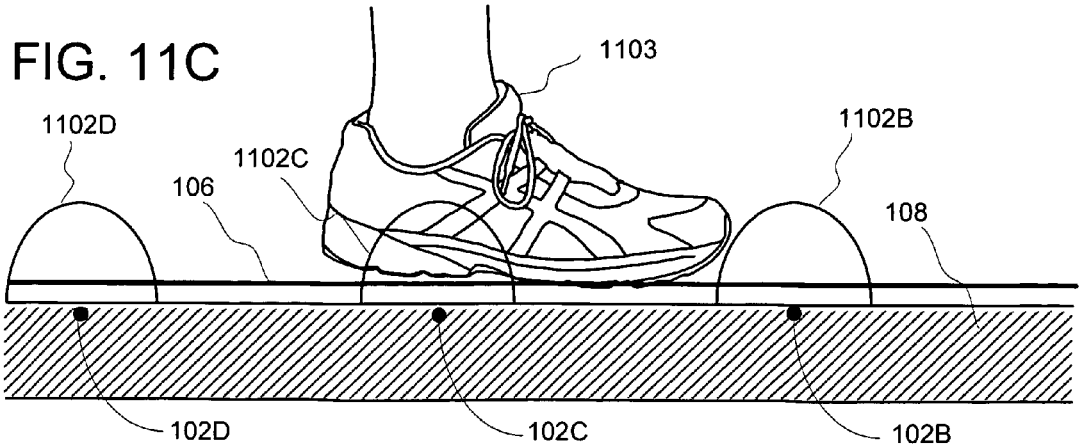

Operation of the control system involves interaction of the system components. In one scenario, the user starts treadmill 100 of FIG. 1 in a manual control mode with a preset belt speed. The user selects control mode and preset belt speed via input device 104. As the belt speed increases from zero to the preset speed, the user walks or runs to keep pace. As the user moves relative to tread belt 106 his or her feet land on the belt as illustrated in FIGS. 11A to 11C. The control system of FIG. 2 uses the changing values of foot sensors 102A-G to detect user footfalls. The system of FIG. 2 uses detected footfalls to initialize the system state and estimate user motion. However, user motion estimates will not be used to control tread belt 106 speed while the system is in a manual control mode.

An example user stride illustrates operating behavior. FIG. 11A shows the heal of user foot 1103 making footfall within range of foot sensor 102C. Sensor filter 308 of FIG. 3 will initially pass all foot sensor states because no user footfall has been previously detected. Event generator 312 of FIG. 3 will generate a more forward event as described in FIG. 5E.

FIG. 4 shows that state machine 310 will start in clear-tread state 402 with an INIT value of false. The first more forward event will cause state machine 310 to move to tread-active state 404 and record sensor number 102C as the new first sensor.

FIG. 11B illustrates the toe of user foot 1103 contacting tread belt 106 within range of foot sensor 102B. This will cause event generator 312 of FIG. 3 to generate a more forward event as described in FIG. 5B. FIG. 4 shows that the more forward event will cause state machine 310 to reenter tread-active state 404 and record foot sensor 102B as the new first sensor. FIG. 6 shows that the more forward event will also cause location travel integrator 612 and timer 607 of stride calculator 302 to be reset to zero.

FIG. 11C illustrates the toe of user foot 1103 clearing detection zone limit 1102B as it moves rearward on tread belt 106. This will cause event generator 312 to generate a forward sensor clear event as shown in FIG. 5D. Note that the user's foot will travel some finite distance between the time it first activates sensor 102B as shown in FIG. 11B and the time the user's toe cleared sensor 102B as shown in FIG. 11C. FIG. 4 shows that the forward sensor clear event causes state machine 310 to exit tread-active state 404 and set the value of travel to the current value of location travel. The value of travel in FIG. 4 now represents the total belt travel between the instant shown in FIG. 11B and the instant shown in FIG. 11C.

FIG. 11C also shows that user foot 1103 is within range of foot sensor 102C. Sensor 102C is the next rearward sensor from sensor 102B which is the current first sensor. Therefore, state machine 310 will transition to footfall-confirmed state 408 as shown in FIG. 4.

FIG. 7 shows that entering the footfall-confirmed state causes user position calculator 306 to produce new estimates of user position. Latch 706 and latch 702 load new data values. The output of latch 706 represents the forward-most position of the user's foot during the most recent footfall. Although a new value is loaded in latch 702 representing the position of the previous footfall, the value is not valid. The value is not valid because only one footfall has been confirmed since treadmill 100 began operating. FIG. 4 shows that the value of INIT remains false after the first footfall detection.

FIG. 6 shows that entering footfall-confirmed state 408 resets timer 604 and integrator 608 of stride calculator 302 to their initial values after a short delay. The output of timer 604 now represents the total time elapsed during the current user stride. The output of integrator 608 now represents the total belt travel during the current user stride.

FIG. 9 shows that entering footfall-confirmed state 408 also causes wait process 901 of speed calculator 304 to allow execution of the remaining process steps of FIG. 9. These steps calculate new speed and acceleration values. However, since the INIT state is still false, test 902 ensures that speed and acceleration values remain set to zero.

Figure 12A:
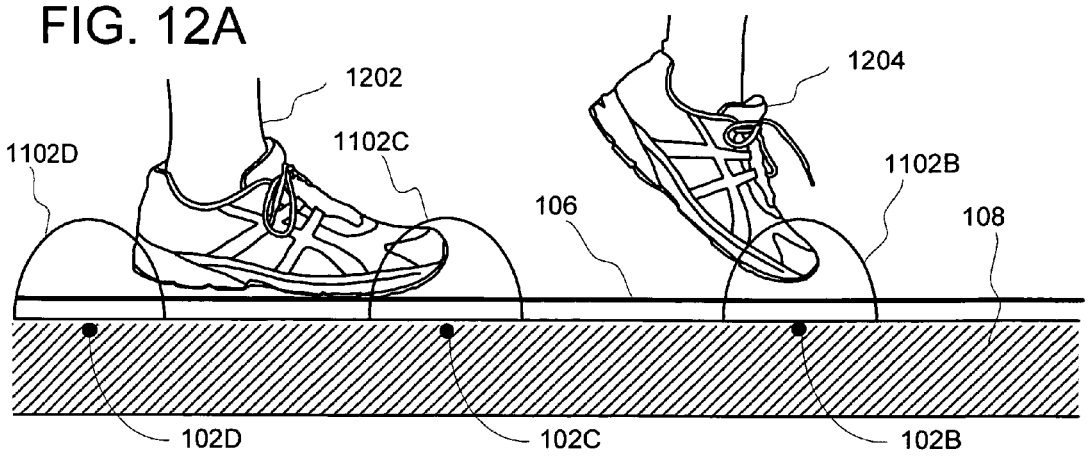
FIGS. 12A and 12B show capacitive sensor detection of a forward moving user foot.

If a second user foot now drags along the belt surface as it draws forward, sensor filter 308 of FIG. 3 will limit sensor activations. Filter 308 will not allow the foot to be detected until a sensor at least two positions ahead of the expected position of the previously detected foot is activated. This provides at least one open sensor between feet to be used for footfall confirmation. FIG. 12A illustrates a situation in which filter 308 would prevent the generation of a more forward event. A user foot 1204 is detected by sensor 102B, but it is less than two sensor positions forward of a previously detected user foot 1202. In this case, filter 308 prevents a potential false footfall detection.

If a more forward event is received while state machine 310 is in footfall-confirmed state 408, the system will transition to tread-active state 404 and will set INIT to true as shown in FIG. 4. Now the footfall detection and confirmation process will repeat. However, after the second confirmed footfall the system is fully initialized and valid values for user speed, acceleration, and position are available to motor controller 218.

To further describe system operation, assume the user now selects an automatic speed adjustment mode via input device 104. During automatic speed adjustment, motor controller 218 adjusts the speed of tread belt 106 by adjusting inputs to motor driver 216. The output of motor driver 216 controls the rate of rotation of motor assembly 210 which is directly related to the speed of tread belt 106. FIG. 10A and FIG. 10B show one embodiment of a proportional, integral, differential feedback controller which is also commonly called a PID controller. Each consecutive user footfall provides an opportunity for the control system to measure user motion resulting in new estimates of user speed, position on tread base 108, and acceleration. These values are combined to determine a new value of the motor control signal. The embodiment of motor controller 218 in FIG. 10B also shows user motion estimates are continually adjusted between footfall events. The continuous adjustments are based on an assumption that the user maintains a constant rate of acceleration between footfalls. Each new footfall provides fresh data to replace the adjusted estimates. The continuously adjusted estimates dramatically improve control system performance under some operating conditions.

Figure 12B:
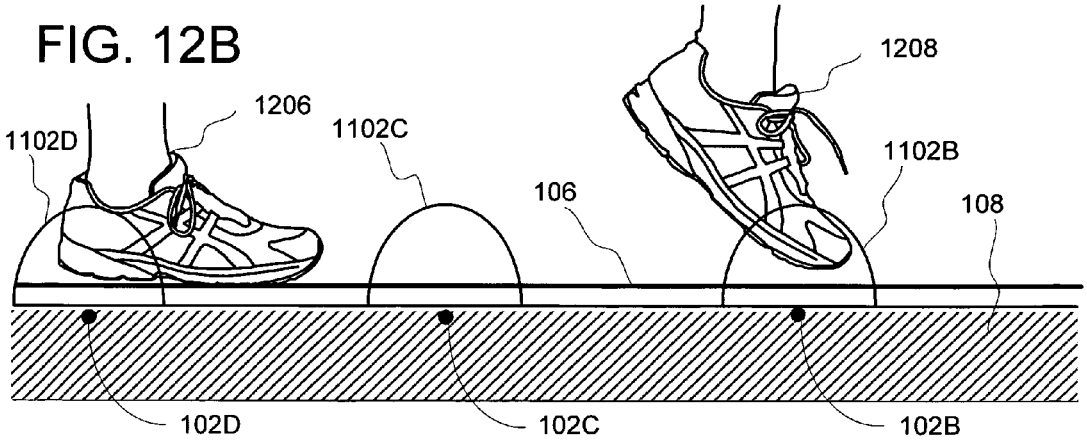
Figure 12C:
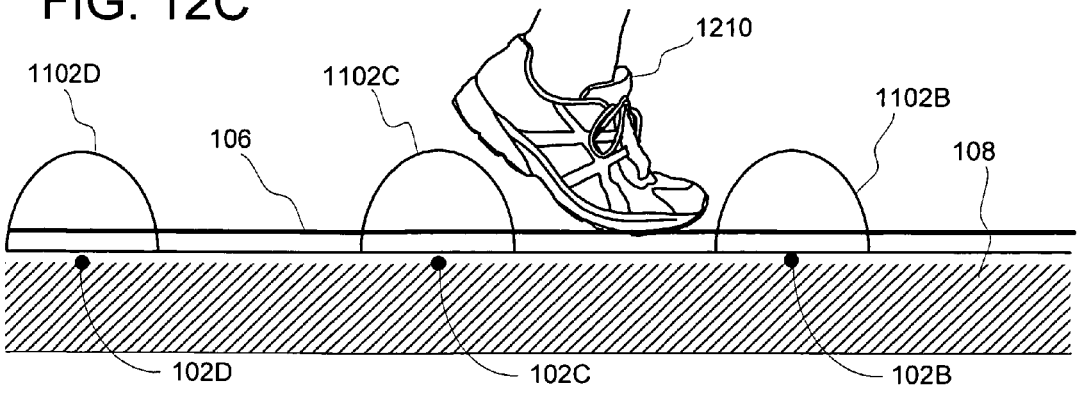
FIG. 12C shows an undetected user foot between two capacitive sensors.

FIG. 12C illustrates a case in which a user foot 1210 clears the most forward sensor before it is detected by the next rearward sensor. This may occur if the user's feet are small, as in the case of a child, the user is an animal with small feet such as a dog, or the runner's style places only a small portion of the foot in contact with tread belt 106. In this case, FIG. 4 shows that state machine 310 will transition from tread-active state 404 to footfall-located state 406 when the user's toe clears detection by sensor 102B. State machine 310 will only transition to footfall-confirmed state 408 when the user's foot comes closer than detection zone limit 1102C to sensor 102C. Thus, the operation of footfall-located state 406 allows state machine 310 to confirm footfalls even when the user's foot is momentarily undetected between two sensors. Footfall-located state 406 also allows state machine 310 to distinguish between a true footfall and a momentary detection of a forward moving foot such as the case illustrated in FIG. 12B. FIG. 12B represents a case where a forward moving user foot 1208 is two sensors ahead of a previously detected user foot 1206 when it enters detection zone 1102A. When foot 1208 clears detection zone 1102B on its way forward, event generator 312 will generate a forward sensor clear event. Since detection zone 1102C is clear, state machine 310 will transition to footfall-located state 406 as shown in FIG. 4. However, when user foot 1208 enters a still further forward detection zone a more forward event will be generated and state machine 310 will transition to tread-active state 404.

Figure 13A:
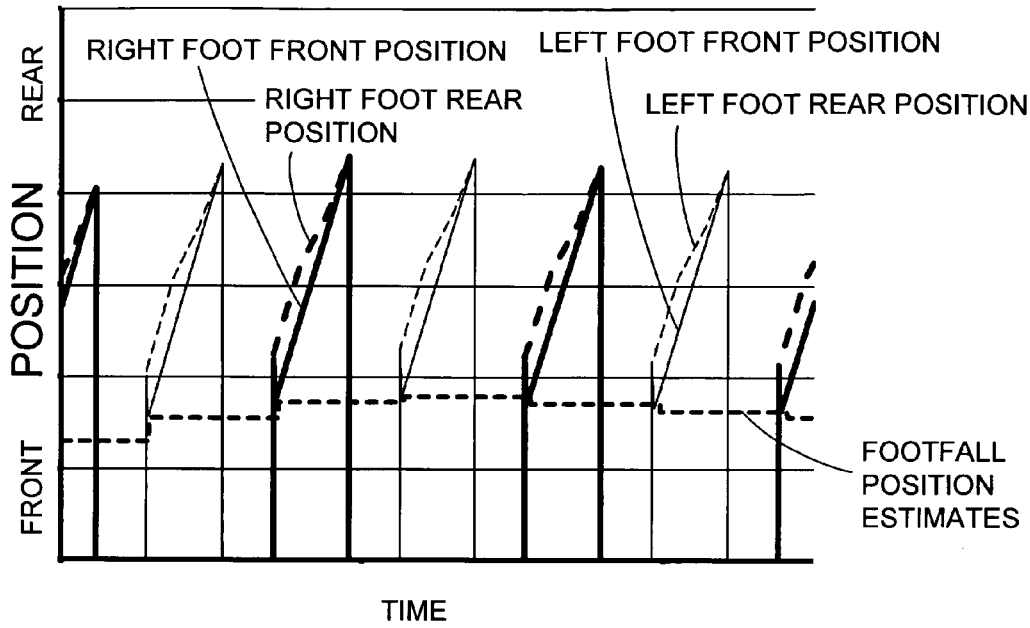
FIGS. 13A to 13D show results of a computer simulation of one embodiment.

FIGS. 13A-D show charted results of a computer simulation of one embodiment. The chart of FIG. 13A shows the front-most and rear-most position of each foot in contact with tread deck 108 over a period of time. FIG. 13A represents one type of user stride. At each time FIG. 13A shows a separation between a foot's front and rear positions, that foot is in contact with tread belt 106. Footfall position estimates also shown in FIG. 13A. FIG. 13A shows that one embodiment produces a substantially accurate footfall position estimate each time a user footfall occurs.

Figure 13B:
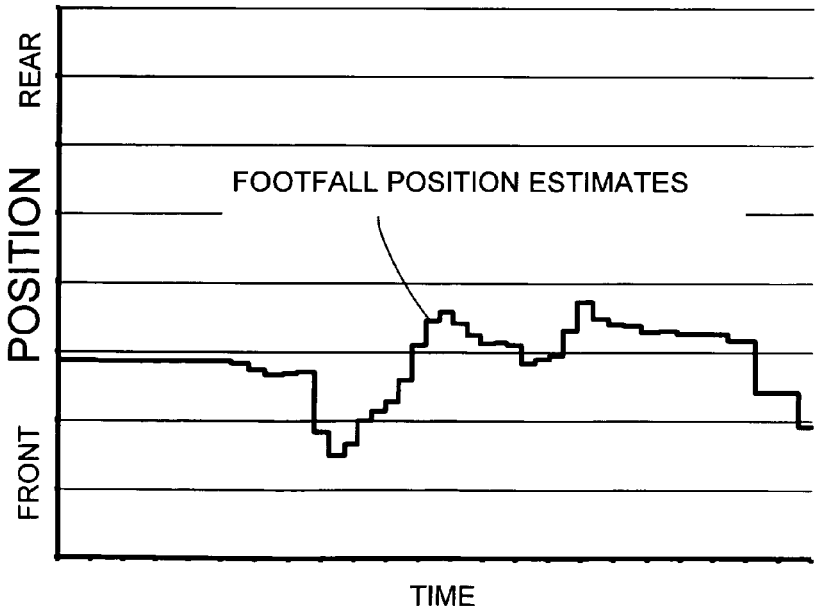

FIG. 13B shows estimated user footfall positions over the course of a simulated period of aggressive user acceleration. FIG. 13B shows that one embodiment produces stable and effective control of user position relative to tread deck 108 under comparatively harsh use conditions.

Figure 13C:
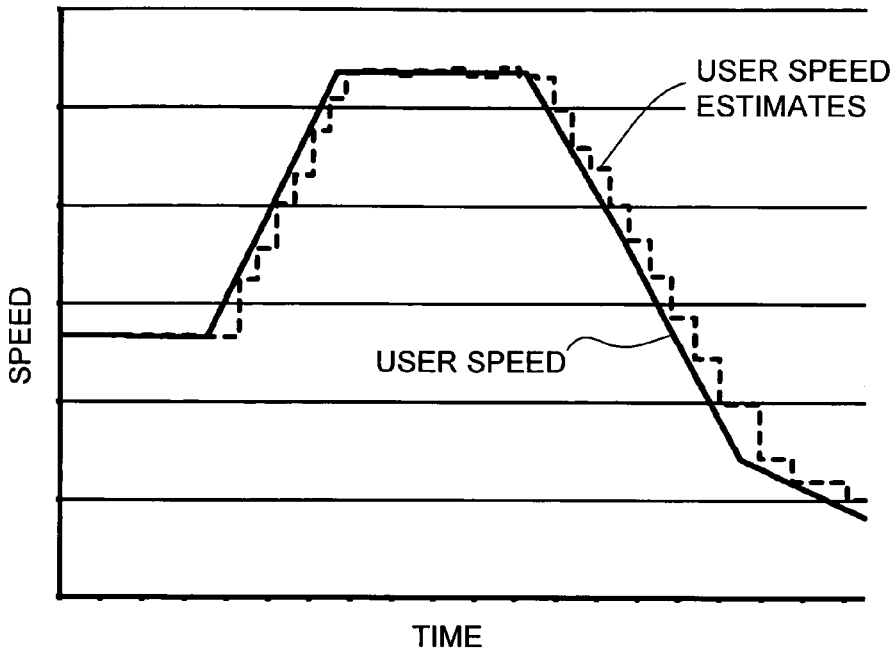

FIG. 13C shows user speed estimates produced by one embodiment during a simulated period of aggressive user acceleration. FIG. 13C shows that one embodiment produces substantially accurate user speed measurements. Differences between speed estimates and user speed are visible in FIG. 13C. These differences arise from simulated sensor limitations, user stride characteristics, and simulated computational limitations of one embodiment.

Figure 13D:
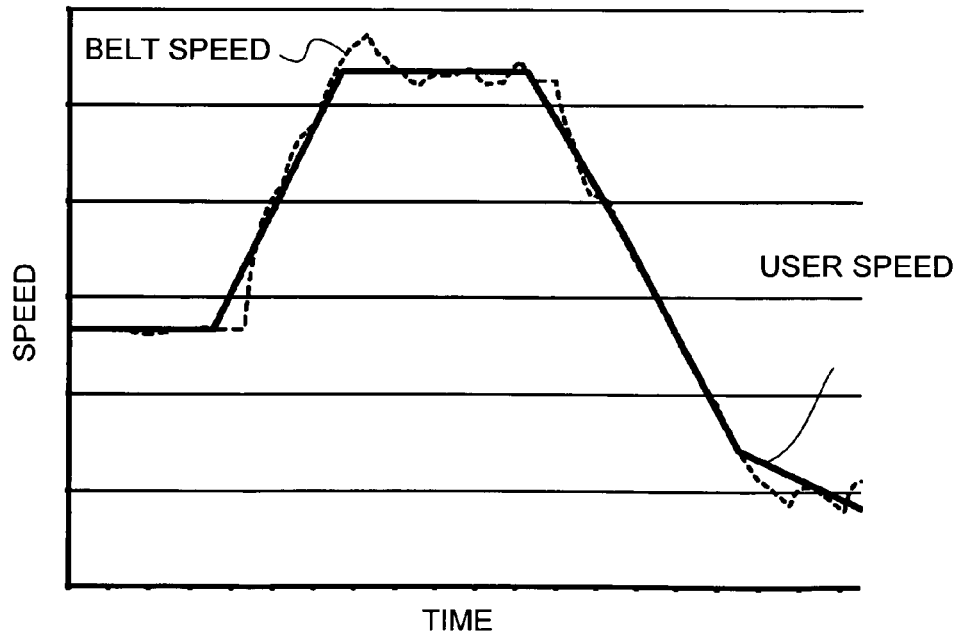

FIG. 13D shows the speed profile of tread belt 106 produced by one embodiment during a simulated period of aggressive user acceleration. The belt speed profile is overlaid on a user speed profile plot. The belt speed of FIG. 13D shows a reasonable and acceptable profile.

Together, FIGS. 13A-D show that one embodiment produces correct and effective automatic speed control in a detailed simulation of control system operation.

Additional Embodiments

Alternate Design of Capacitive Sensing Elements—FIG. 14

Figure 14A:
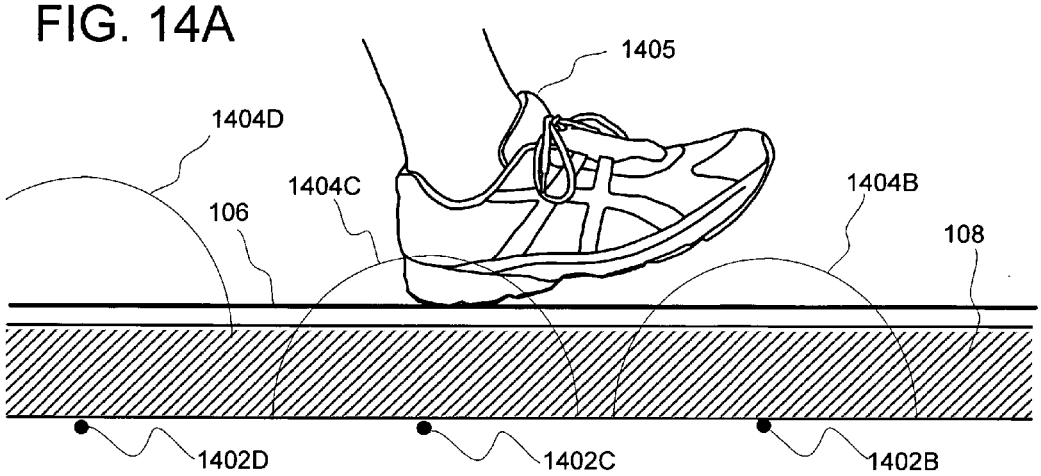
FIG. 14A shows an alternate location of capacitive sensor wires.
Figure 14B:
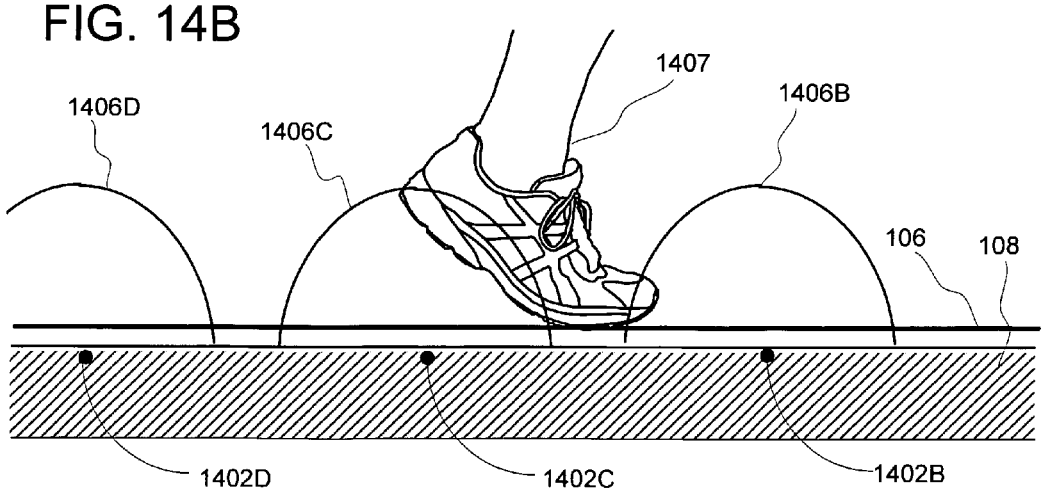
FIG. 14B shows expanded detection zones for capacitive sensors.

In additional embodiments, the shape and extent of detection zones are modified by changing the placement of capacitive sensing elements and by other aspects of sensor design. FIG. 14A illustrates the flattened detection zone 1404B-1404D of sensor elements 1402B-1402D created by moving sensor elements to the underside of tread base 108. FIG. 14B illustrates the expanded detection zones 1406B-1406D of sensor elements 1408B-1408D which may be achieved by a number of sensor design choices, including sensor operating voltage and location of ground planes. Alternative placement and design of sensing elements may reduce production costs or improve foot sensing reliability.

Additional Embodiments

Figure 15:
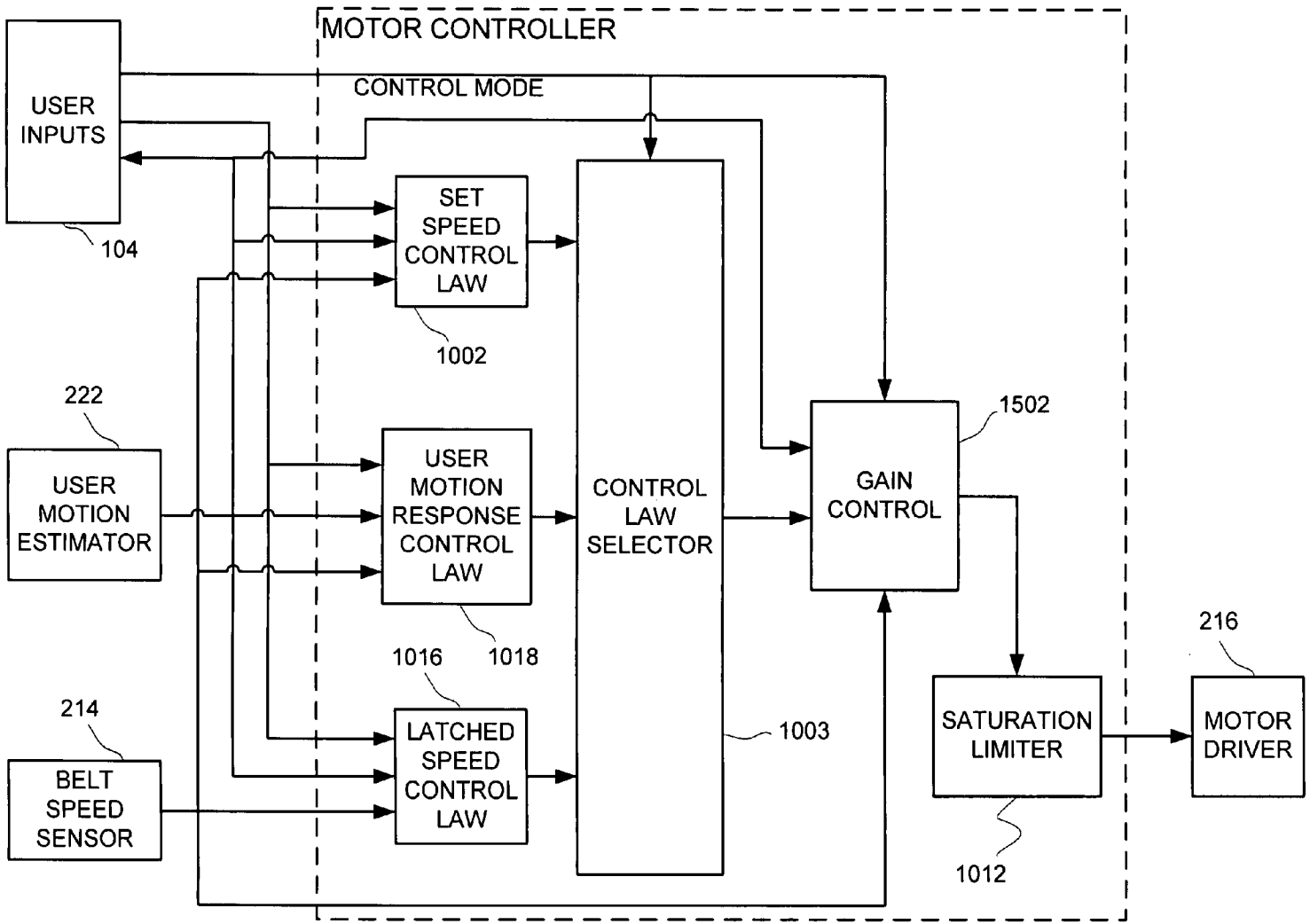
FIG. 15 shows an alternate embodiment of gain control in a motor controller.

Variable Gain Controller—FIG. 15

In an additional embodiment, control parameters are adjusted during treadmill operation. Gain values 1018, 1022, 1034, and 1040 of motor controller 218 are based on the current values of a number of system state variables. Also target user position is adjusted. FIG. 15 illustrates one such embodiment where a gain control 1502 provides the gain values, regulated by belt speed, control inputs from the user, and user motion estimates. The variable gain embodiment allows for optimized gain setting at low, medium, and high user speeds. The variable gain embodiment additionally allows optimization of gain setting for walking, normal jogging, and wind sprint use modes where particular ranges of acceleration may be expected. FIG. 15 also shows user motion estimates are provided to user inputs 104 for use in determination of the most advantageous user target position. Variable parameter settings create a better user experience by providing improved control in a variety of use circumstances.

Additional Embodiments

Figure 16:
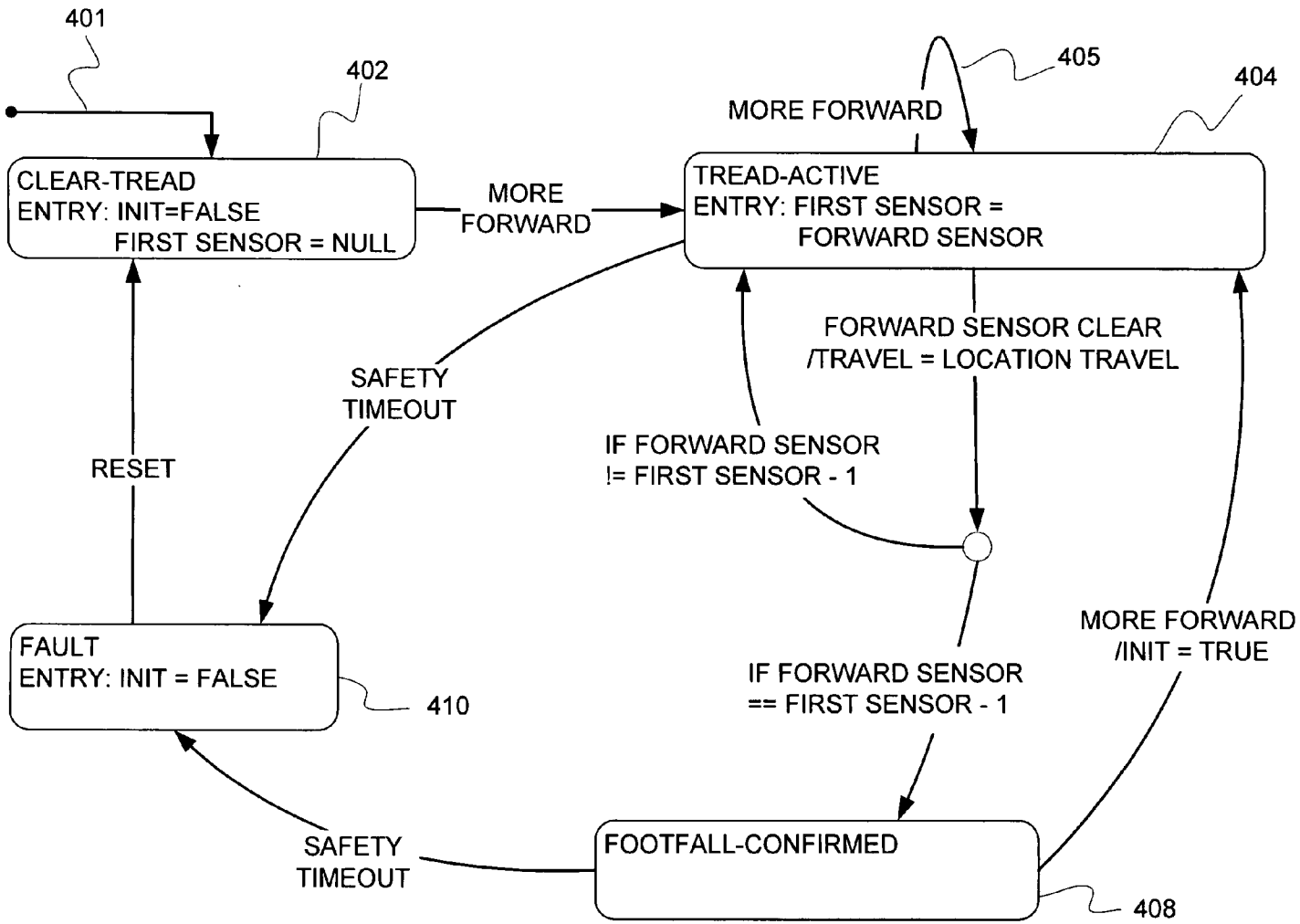
FIG. 16 shows a simplified footfall state machine state transition diagram.

Simplified State Machine—FIG. 16

In an additional embodiment, state machine 310 is simplified compared with the embodiment of FIG. 4. FIG. 16 shows one embodiment which eliminates footfall-located state 406 and the associated state transitions. This can be done without loss of function if the smallest user foot can be assumed to always trigger the next rearward of foot sensors 102A-102G before clearing the next more forward of sensors 102A-102G when it is landed on tread belt 106. Simplified state machine embodiments may be more economical to implement.

Additional Embodiments

Figure 17:
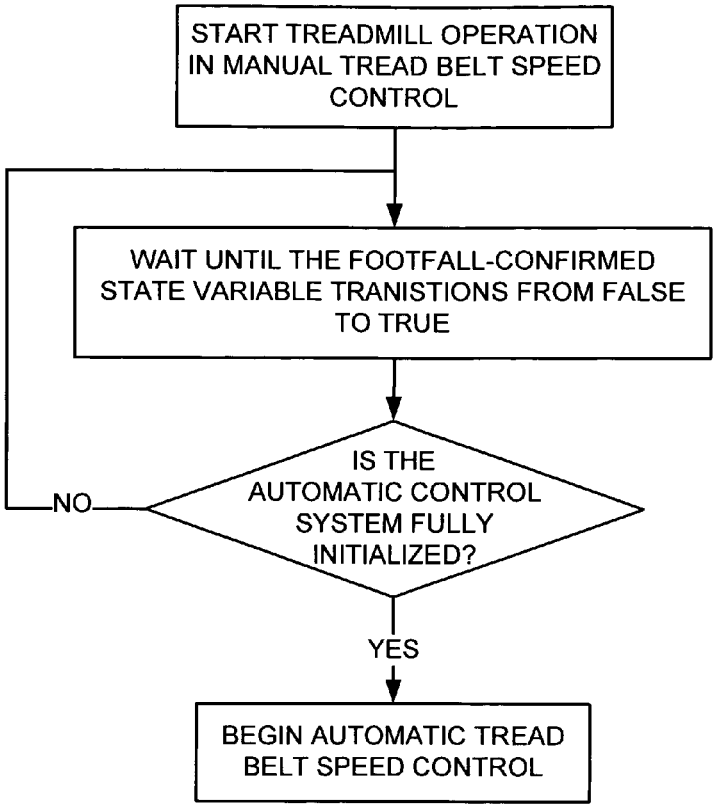
FIG. 17 shows an automatic control mode transition mechanism.

Automatic Mode Transition—FIG. 17

In an additional embodiment, input device 104 includes a user selected control option to automatically transition from manual to automatic speed control.

FIG. 17 shows a flow diagram of the automatic transition of one embodiment. In the flow diagram of FIG. 17 automatic mode transition will occur when state machine 310 enters footfall-confirmed state 408 while the system is initialized. A range of alternative transition points may be used. In one embodiment, the user can select automatic transition control mode before tread belt 106 begins moving and then start the operation of treadmill 100 in a target speed tracking control mode. The control mode will transition to user speed tracking mode without further user actions when all transition conditions are met.

Automatic mode transition provides a more natural user exercise experience.

Additional Embodiments

Figure 18:
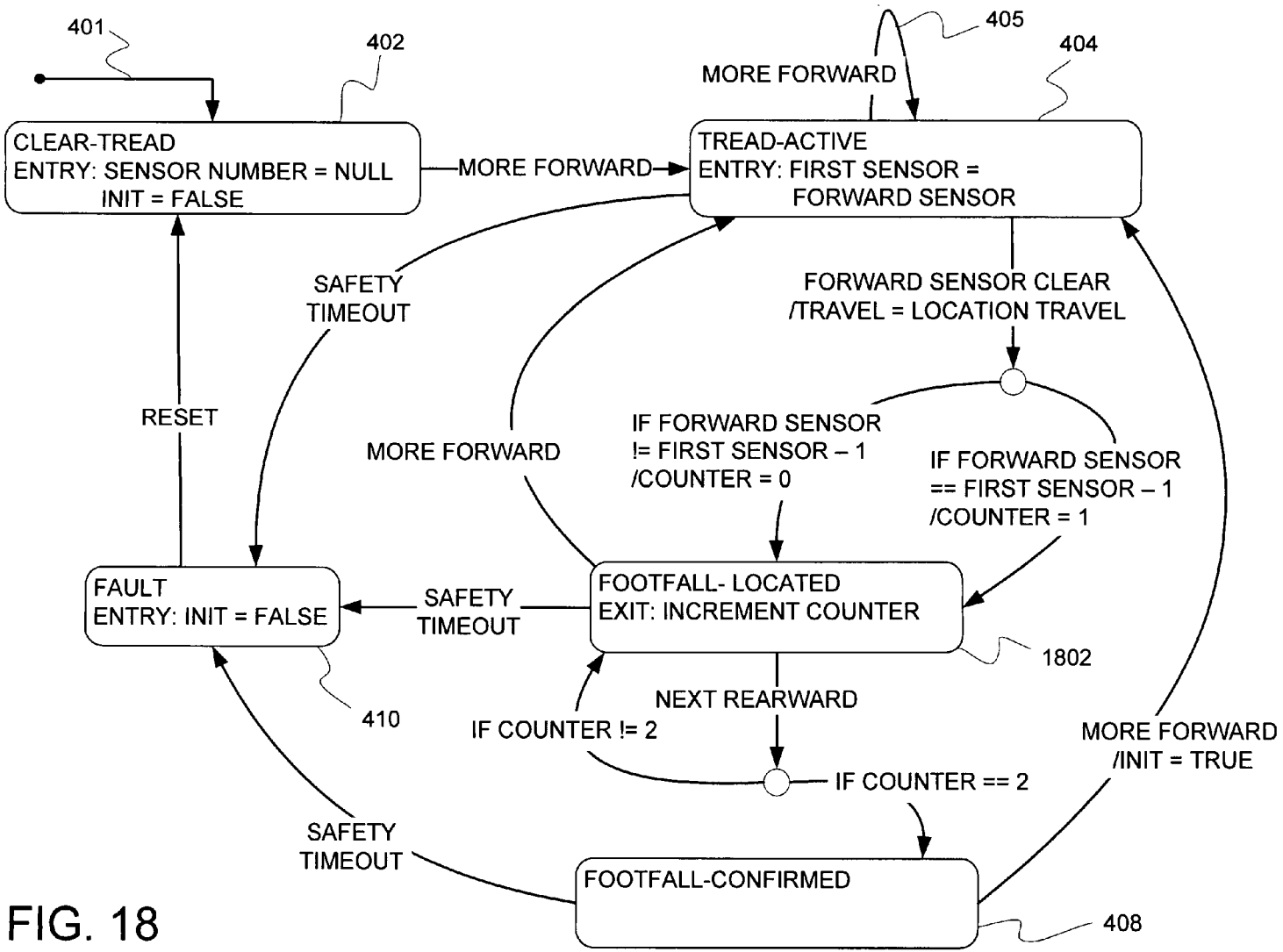
FIG. 18 shows a more advanced footfall state machine state transition diagram.

More Advanced State Machine—FIG. 18

In additional embodiments, state machine 310 may be supplemented with additional states or other features to improve operation.

In one embodiment, state machine 310 incorporates more robust confirmation of user footfalls. The state machine diagram of FIG. 18 shows modifications of footfall-located state 1802, its inputs, and outputs relative to FIG. 4. The additional features cause state machine 310 to remain in state 1802 until a user's foot activates two consecutive next rearward foot sensors 102A-102G after activating and clearing a more forward sensor.

Particular stride types might produce sensor activations indicating a true footfall but which are actually caused by a forward-moving foot. The modified state machine diagram of FIG. 18 eliminates false footfall detections in circumstances that may occur while the user's foot is moving forward on or above tread belt 106. Elimination of false footfall detections improves the quality of control system performance. In some cases, such as treadmill designs incorporating many closely spaced foot sensor elements, the modifications of FIG. 18 will improve footfall detection reliability.

Additional Embodiments

Adaptive Foot Sensor Sensitivity—FIG. 19

Figure 19A:
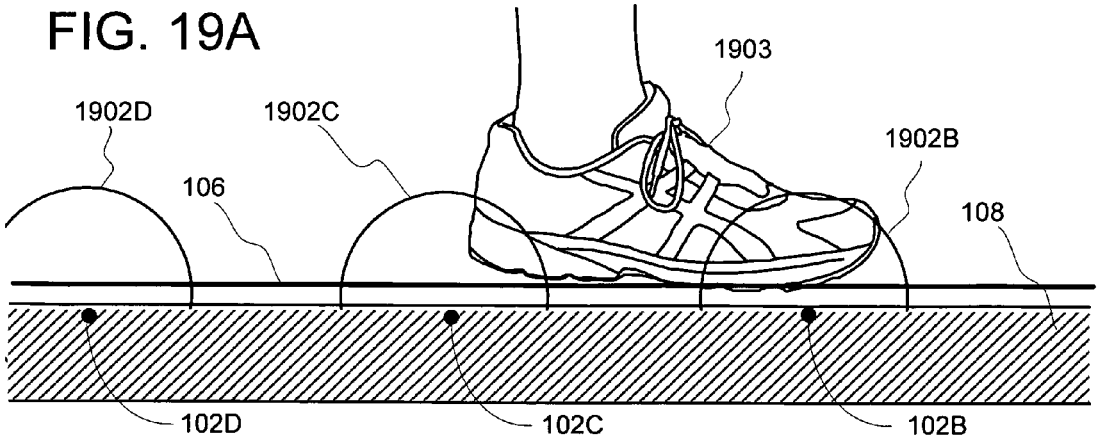
FIG. 19 shows adaptive foot sensor adjustments of an alternate embodiment.
Figure 19B:
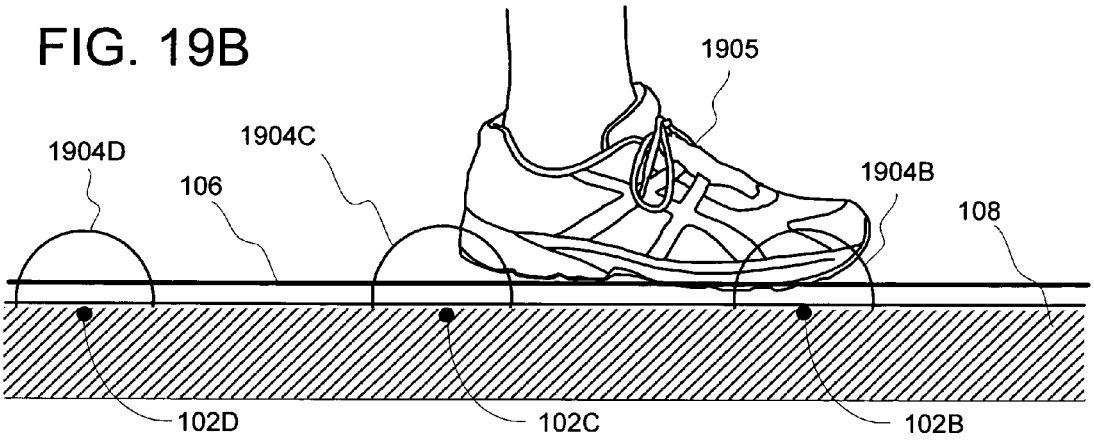
Figure 19C:
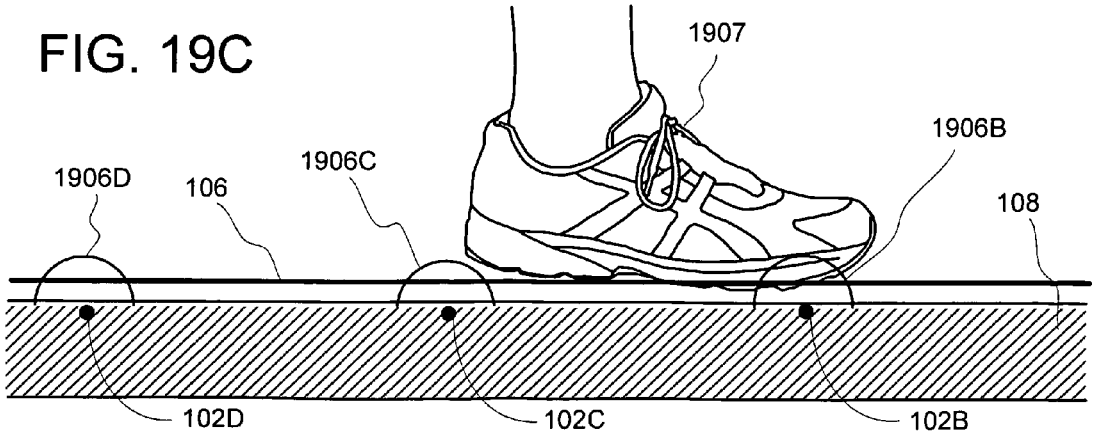

In an additional embodiment, foot detector 226 adjusts electronic characteristics of foot sensors 102A-102G during treadmill 100 operation. The electronic adjustments produce changes to the effective detection range of foot sensors 102A-102G as shown in FIG. 19A-19C. After an initial period of systematic electronic characteristic adjustment, foot detector 226 selects a set of electronic characteristics settings to be maintained for some portion of future operations of treadmill 100.

The selected settings may minimize detection range of foot sensors 102A-102G in order to reduce sensor detection of a user's feet while they are not in direct contact with tread belt 106. Alternately, the selected settings may maximize detection range of foot sensors 102A-102G in order to reduce the space between foot sensors 102A-102G where a user's foot may be in contact with tread belt 106 but remain undetected. Alternately, the selected settings may optimally balance a plurality of qualities of foot sensors 102A-102G.

Adaptive sensitivity of foot sensors 102A-102G adjust the foot sensing components such that the effectiveness of the control system is maintained despite variation in a range of operating variables which might otherwise affect control system performance. These variables include user physiology, user footwear characteristics, tread belt 106 wear, foot detector 226 component aging, ambient temperature, and variation in manufacturing processes among other variables. Adaptive sensitivity thus improves control system performance and reduces required instances of system maintenance.

Additional Embodiments

Figure 20:
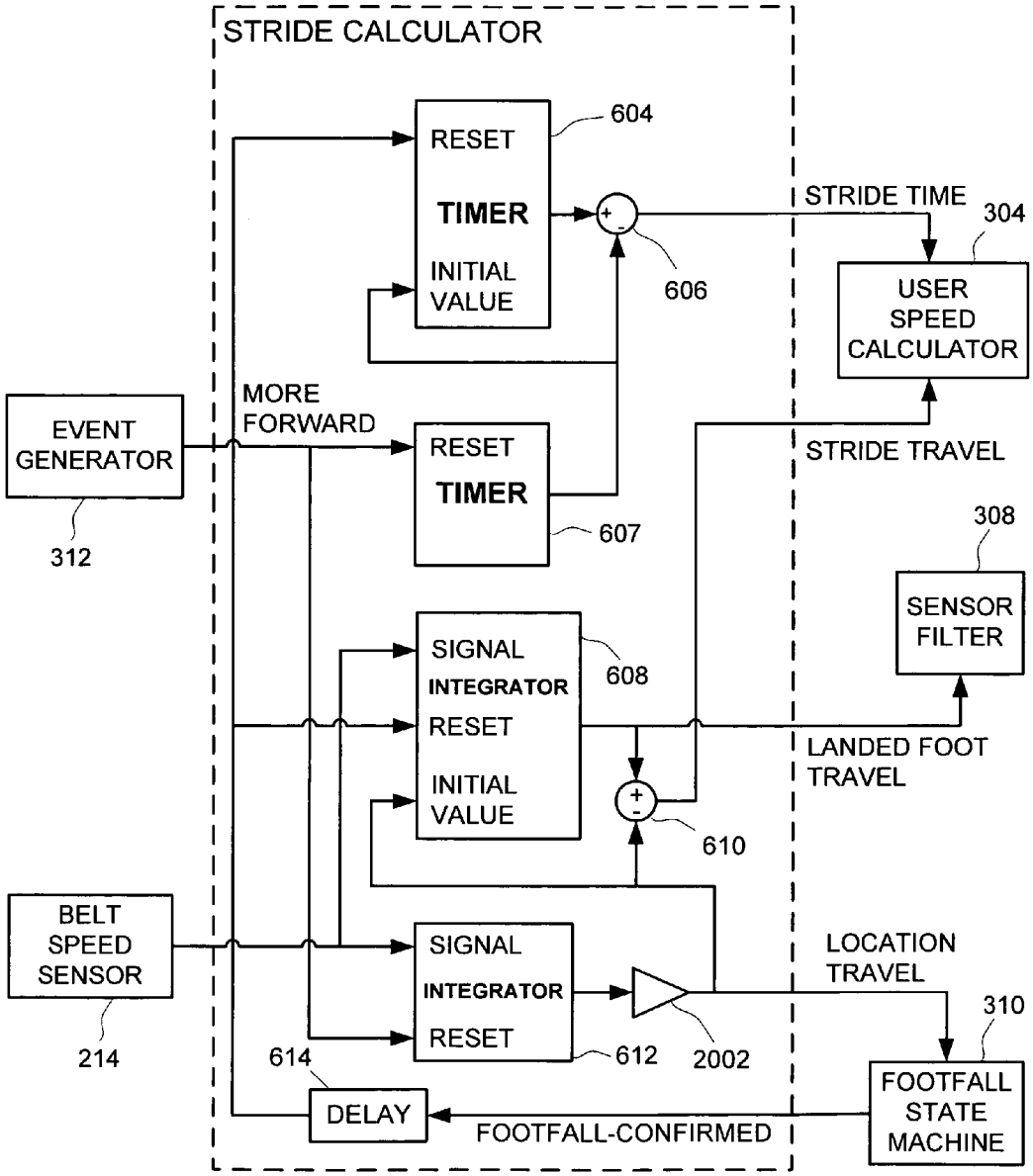
FIG. 20 shows a stride calculator system block diagram of an alternative embodiment.

Improved Footfall Position Estimation—FIG. 20

In an additional embodiment, the estimation of footfall position is improved by estimating the amount of belt travel that occurs between activation of the most forward of foot sensors 102A-102G to be activated during a user footfall and the point of actual footfall on tread belt 106. Improved estimates may be based upon statistical studies of simpler embodiments or upon other more sophisticated interpretations of sensor data. In one embodiment, a fixed percentage of elapsed time between most forward sensor activation and most forward sensor clearing is assumed to take place before actual footfall. FIG. 20 shows the addition of fractional multiplier 2002 to the system block diagram of stride calculator 302. Fractional multiplier 2002 reduces the foot travel estimate of stride calculator 302 by twenty percent.

Alternative footfall position estimation embodiments produce more accurate user speed, position, and acceleration estimates for use in motor controller 218. More accurate estimates produce improved automatic speed control and a better overall user experience.

Alternative Embodiments

Alternative Foot Sensing Technologies

In alternative embodiments, any foot sensing technology detecting the presence or absence of a user's foot at points along the tread belt may be used in combination with the elements of the control system. For example, photo sensing, pressure sensing, radio sensing, and other sensor types may be used to provide foot position detection information to the control system.

CONCLUSIONS, RAMIFICATIONS, AND SCOPE

Accordingly, the reader will see that the treadmill control devices of the various embodiments can be used to provide a more natural exercise experience for the user by automatically adjusting the speed of the treadmill exercise device. In addition, the ability of the several embodiments to more accurately estimate user footfall positions, to more accurately compute user speed relative to the tread belt, to more accurately compute the acceleration of the user relative to the tread belt, and to use these measurements as inputs to a feedback control system can produce a more responsive, more cost effective, and more stable automatic speed adjustment system. Furthermore, the capacitive foot sensing elements of some embodiments provide a lower cost, easily manufactured, and more flexible foot sensing technology that can extend beneath the tread belt surface without being subject to wear.

The control devices have additional advantages in that:

- the capacitive sensing elements present no mechanical interference to the user or the exercise mechanism.
- the sensitivity of the capacitive sensing elements may be set adaptively during treadmill operation in order to optimize foot detection and location in current operating conditions.
- the control system may be implemented in a wide variety of technologies such as computer software, field programmable gate arrays, discreet logic devices, analog electronic devices, or combinations of such technologies which may balance cost, performance, and reliability characteristics desired in an application.
- some embodiments of the control system employ continually updated estimates of user motion between user footfall events, thus improving responsiveness and stability of control.
- some embodiments employ adjustable gain values, allowing optimization of important control system parameters for specific operating conditions.
- the control system may be implemented in a wide variety of sophistication levels, trading off cost and complexity versus performance and ease of use, and that these varieties may be attractive in a range of applications.
- a variety of alternative foot sensing technologies, other than capacitive sensing, as might be available now or in the future, may be used to provide foot position inputs to the control system.
- the control system supports a wide variety of user types and use styles including users with unusual strides, users with small feet, and users with a multiplicity of feet such as dogs among other user types.

Although the descriptions detailed heretofore contain many specificities, these should not be construed as limiting the scope of the embodiments but as merely providing illustrations of some of the presently preferred embodiments. For example, the embodiment of motion estimator 222 illustrated in FIG. 3 is only one of many possible implementations of a user motion estimator that would produce the required estimates of user motion.

Thus the scope of the embodiments should be determined by the appended claims and their legal equivalents, rather than by the examples given.

I claim:

1. A treadmill control system comprising:

a. a tread base, b. a moving tread belt supported by said tread base on which a user can run or walk, c. a belt motion sensor to generate belt motion measurements related to the speed or displacement of said tread belt, d. a motor assembly to drive said tread belt at a variable speed, e. a plurality of foot sensors to detect the presence or absence of a user foot at various positions along said tread base, f. a compute mechanism which uses the outputs of said foot sensors to detect actual user footfalls distinct from other types of events that can activate said foot sensors, the events comprising: a dragged user foot, a skipping user foot, a user foot moving slightly above said tread belt, or a foreign object, g. a compute mechanism which uses detected user footfalls to produce footfall position estimates of the location of each user footfall upon said tread belt, h. a motor controller which adjusts the speed of said motor assembly in response to footfall position estimates, whereby the speed of said tread belt automatically responds to user position.

2. The treadmill control system of claim 1 wherein also comprising a compute mechanism which produces footfall position estimates of higher precision than the spacing of said foot sensors.

3. The treadmill control system of claim 1, wherein also comprising:

a. a compute mechanism which uses detected user footfalls to produce stride time estimates of the elapsed time between consecutive user footfalls upon said tread belt, b. a compute mechanism which uses stride time estimates, footfall position estimates, and belt speed estimates to produce user motion estimates, c. a compute mechanism provided by said motor controller which adjusts the speed of said motor assembly in response to user motion estimates, whereby the speed of said tread belt automatically responds to user motion.

4. The treadmill control system of claim 3 wherein also comprising a compute mechanism which adjusts estimates of user motion and position during the time interval between user footfalls, whereby responsiveness of said motor controller to user motion is improved.

5. The treadmill control system of claim 3 wherein said user motion estimates include user speed estimates.

6. The treadmill control system of claim 3 wherein said user motion estimates include user acceleration estimates based on the difference between consecutive user speed estimates and the time interval between consecutive estimates.

7. The treadmill control system of claim 3 wherein said motor controller also comprises a compute mechanism to control said tread belt speed based on the sum of several factors, each weighted by a gain multiplier, the several factors comprising:

a. the difference between tread belt acceleration estimates and user acceleration estimates, b. the difference between tread belt speed estimates and user speed estimates, c. the difference between footfall position estimates and a target footfall position, d. the time integral of the difference between footfall position estimates and said target footfall position, whereby each factor contributes to said tread belt speed control in a complimentary fashion.

8. The treadmill control system of claim 7 wherein also comprising:

a. one or more than one user input device;

b. a compute mechanism to change said gain factors, regulated by a user's input from said user input device and other control system variables, whereby the performance characteristics of said treadmill control system can be matched to user preferences and optimized for current operating conditions.

9. The treadmill control system of claim 1, wherein said footfall sensors are capacitive proximity sensors which detect the presence or absence of a user's feet at a plurality of positions along said tread base.

10. The treadmill control system of claim 9 wherein also comprising a compute mechanism to adjust the sensitivity of said capacitive proximity sensors over some period of time by interpretation of said capacitive proximity sensor outputs, whereby the resultant range of proximity detection is advantageous to the operation of said treadmill control system.

11. A method to control a treadmill which includes a moving tread belt and a tread base supporting said tread belt upon which a user can run or walk, comprising the steps of:

a. estimating the speed of said tread belt by means of a belt speed sensor, b. driving said tread belt at a variable speed by means of a motor assembly, c. detecting the presence or absence of a user foot at various positions along said tread base by means of a plurality of foot sensors and a compute mechanism, d. detecting actual user footfalls upon said tread belt distinct from other types of events that can activate said foot sensors by means of said foot sensors, said belt speed sensor, and said compute mechanism, the events comprising: a dragged user foot, a skipping user foot, a user foot moving slightly above said tread belt, or a foreign object, e. estimating the location of each actual user footfall by means of said foot sensors, said belt speed sensors, and said compute mechanism, f. adjusting the speed of said motor assembly in response to said footfall position estimate by means of a motor controller, whereby the speed of said tread belt automatically responds to user position.

12. The method of claim 11 wherein the location of each actual user footfall upon said tread belt is estimated to a higher precision than the spacing of said foot sensors by means of said foot sensors, said belt speed sensors, and a compute mechanism.

13. The method of claim 11, wherein also comprising the steps of:

a. estimating the time of each actual user footfall upon said tread belt by means of said foot sensors, said belt speed sensors, and a compute mechanism, b. estimating user motion based upon footfall time estimates, footfall position estimates, and belt speed estimates by means of said foot sensors, said belt speed sensors, and a compute mechanism, c. adjusting the speed of said motor assembly in response to said user motion estimates by means of said motor controller, whereby the speed of said tread belt automatically responds to user motion.

14. The method of claim 13 wherein also comprising the step of adjusting estimates of user motion and user position during the time interval between user footfalls by means of a compute mechanism and said motor controller, whereby responsiveness of said motor controller to user motion and user position is improved.

15. The method of claim 13 wherein said user motion estimates include user speed estimates.

16. The method of claim 13 wherein said user motion estimates include user acceleration estimates based on the difference between consecutive user speed estimates and the time interval between consecutive estimates.

17. The method of claim 13 also comprising the step of adjusting the speed of said tread belt, based on the sum of several factors, each weighted by a gain multiplier, the several factors comprising:

a. the difference between tread belt acceleration estimates and user acceleration estimates, b. the difference between tread belt speed estimates and user speed estimates, c. the difference between footfall position estimates and a target footfall position, d. the time integral of the difference between footfall position estimates and said target footfall position, by means of said motor assembly, said motor controller, and a compute mechanism, whereby each factor contributes to said tread belt speed control in a complimentary fashion.

18. The method of claim 17 also comprising the steps of:

a. monitoring one or more than one user input device by means of a compute mechanism;

b. changing said gain factors, based on a user's input from said user input device and other control system variables by means of a compute mechanism, whereby the performance characteristics of said treadmill can be matched to user preferences and optimized for current operating conditions.

19. The method of claim 11, wherein said footfall sensors are capacitive proximity sensors which detect the presence or absence of a user's feet at a plurality of positions along said tread base.

20. The method of claim 19 also comprising the step of adjusting the sensitivity of said capacitive proximity sensors over some period of time by means of said capacitive proximity sensors and a compute mechanism, whereby the resultant range of proximity detection is advantageous to the operation of said treadmill.

* * * * *